US010638247B2

(12) United States Patent
Leppänen et al.

(10) Patent No.: US 10,638,247 B2
(45) Date of Patent: Apr. 28, 2020

(54) AUDIO PROCESSING

(71) Applicant: Nokia Technologies Oy, Espoo (FI)

(72) Inventors: Jussi Leppänen, Tampere (FI); Arto Lehtiniemi, Lempäälä (FI); Antti Eronen, Tampere (FI); Juha Arrasvuori, Tampere (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 15/798,891

(22) Filed: Oct. 31, 2017

(65) Prior Publication Data

US 2018/0124543 A1 May 3, 2018

(30) Foreign Application Priority Data

Nov. 3, 2016 (EP) ..... 16196973

(51) Int. Cl.
*H04S 7/00* (2006.01)
*H04S 3/00* (2006.01)

(52) U.S. Cl.
CPC ..... *H04S 7/303* (2013.01); *H04S 3/008* (2013.01); *H04S 2400/01* (2013.01); *H04S 2400/11* (2013.01)

(58) Field of Classification Search
CPC ..... H04S 7/303; H04S 7/304; H04S 3/0005; H04S 3/008; H04S 2400/01
USPC ..... 381/303, 58–59
See application file for complete search history.

(56) References Cited

U.S. PATENT DOCUMENTS

2002/0172379 A1* 11/2002 Cliff ..... G11B 27/002 381/119
2009/0128581 A1 5/2009 Brid et al.
2011/0069843 A1* 3/2011 Cohen ..... H04S 1/00 381/56
2014/0002580 A1* 1/2014 Bear ..... H04N 5/445 348/14.07
2014/0328505 A1* 11/2014 Heinemann ..... H04S 7/303 381/303
2015/0078556 A1 3/2015 Shenoy et al.
2015/0098584 A1 4/2015 Emani et al.
(Continued)

FOREIGN PATENT DOCUMENTS

WO 2016/102737 A1 6/2016

OTHER PUBLICATIONS

Shah et al., "Metrics for Measuring Ideation Effectiveness", Design Studies, vol. 24, No. 2, Mar. 2003, pp. 111-134.
(Continued)

*Primary Examiner* — Disler Paul
(74) *Attorney, Agent, or Firm* — Harrington & Smith

(57) ABSTRACT

A method comprising: causing rendering of a first sound scene comprising multiple first sound objects; in response to direct or indirect user specification of a change in sound scene from the first sound scene to a mixed sound scene based in part on the first sound scene and in part on a second sound scene, causing selection of one or more second sound objects of the second sound scene comprising multiple second sound objects; causing selection of one or more first sound objects in the first sound scene; and causing rendering of a mixed sound scene by rendering the first sound scene while de-emphasising the selected one or more first sound objects and emphasising the selected one or more second sound objects.

19 Claims, 9 Drawing Sheets

(56) References Cited

U.S. PATENT DOCUMENTS

| | | | | |
|---|---|---|---|---|
| 2016/0149547 | A1* | 5/2016 | Rider | H03G 3/04 381/57 |
| 2017/0295446 | A1* | 10/2017 | Thagadur Shivappa | G06F 3/011 |
| 2018/0007488 | A1* | 1/2018 | Horowitz | G06F 3/0304 |
| 2018/0046431 | A1* | 2/2018 | Thagadur Shivappa | H04S 7/304 |
| 2018/0352360 | A1* | 12/2018 | Chen | H04S 7/303 |

OTHER PUBLICATIONS

Smith., "Idea-Generation Techniques: A Formulary of Active Ingredients", Journal of creative behavior, vol. 32, No. 2, Jun. 1998, pp. 107-133.

Smith, "Towards a logic of innovation", The International Handbook on Innovation, Dec. 2005. p. 347-365.

European Application No. 16188437.4, "Audio Processing", filed on Sep. 13, 2016, 23 pages.

Extended European Search Report received for corresponding European Patent Application No. 16196973.8, dated Apr. 21, 2017, 8 pages.

Tsakostas et al., "Real-Time Spatial Representation of Moving Sound Sources", Audio Engineering Society Convention Paper 7279, 123rd Convention, Oct. 5-8, 2007, pp. 1-9.

Kastbauer, "The Wwise Project Adventure—A Handbook for Creating Interactive Audio Using Wwise", Audiokinetic Inc., Jan. 1, 2014, 309 pages.

"Interpolation", Wikipedia, Retrieved on Nov. 16, 2017, Webpage available at : https://en.wikipedia.org/wiki/Interpolation.

* cited by examiner

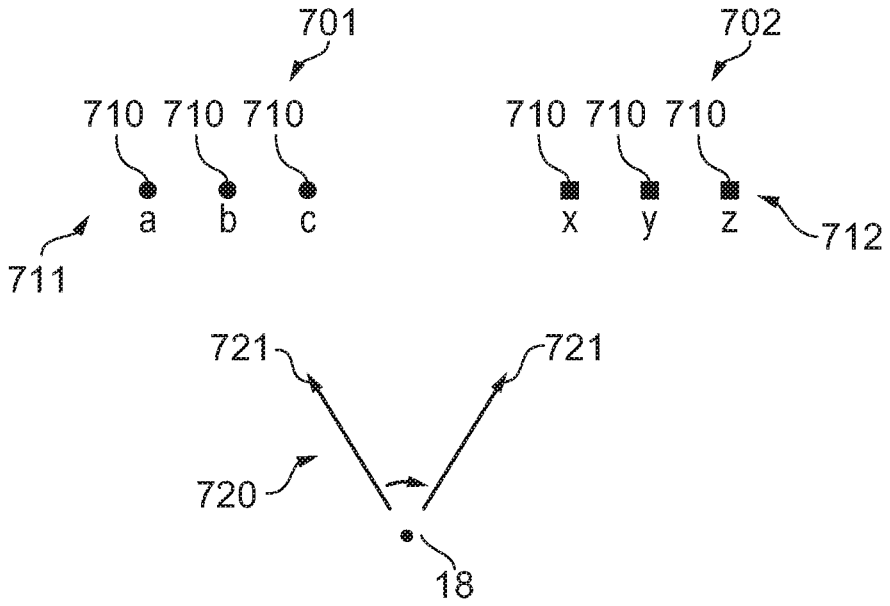
FIG. 12
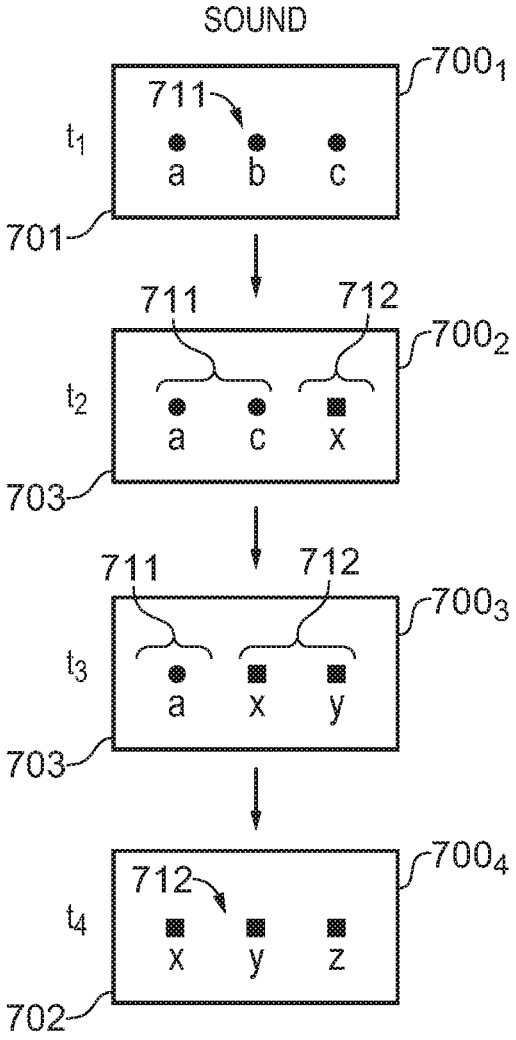
FIG. 13A
FIG. 13B
FIG. 13C
FIG. 13D
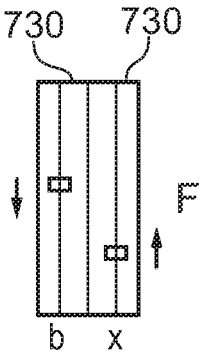
FIG. 14A
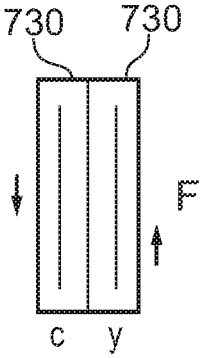
FIG. 14B
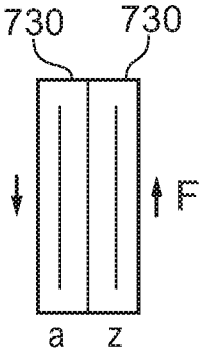
FIG. 14C

AUDIO PROCESSING

TECHNOLOGICAL FIELD

Embodiments of the present invention relate to audio processing. Some but not necessarily all examples relate to automatic control of audio processing.

BACKGROUND

Spatial audio rendering comprises rendering sound scenes comprising sound objects at respective positions.

Each sound scene therefore comprises a significant amount of information that is processed aurally by a listener. The user will appreciate not only the presence of a sound object but also its location in the sound scene and relative to other sound objects.

BRIEF SUMMARY

According to various, but not necessarily all, embodiments of the invention there is provided a method comprising: causing rendering of a first sound scene comprising multiple first sound objects; in response to direct or indirect user specification of a change in sound scene from the first sound scene to a mixed sound scene based in part on the first sound scene and in part on a second sound scene, causing selection of one or more second sound objects of the second sound scene comprising multiple second sound objects; causing selection of one or more first sound objects in the first sound scene; and causing rendering of a mixed sound scene by rendering the first sound scene while de-emphasising the selected one or more first sound objects and emphasising the selected one or more second sound objects.

According to various, but not necessarily all, embodiments of the invention there is provided examples as claimed in the appended claims.

The impact on a user that occurs when one sound scene transitions, temporarily or more permanently, to another sound scene is therefore lessened.

BRIEF DESCRIPTION

For a better understanding of various examples that are useful for understanding the brief description, reference will now be made by way of example only to the accompanying drawings in which:

FIGS. 1A-1C and 2A-2C illustrate examples of mediated reality in which FIGS. 1A, 1B, 1C illustrate the same virtual visual space and different points of view and FIGS. 2A, 2B, 2C illustrate a virtual visual scene from the perspective of the respective points of view;

FIG. 12 illustrates a sound space comprising sound objects including multiple first sound objects and multiple second sound objects;

FIGS. 13A to 13D illustrate examples of sound scenes rendered at successive times;

FIGS. 14A-14C illustrate examples of simultaneously transitioning in a sound object and transitioning out a sound object to achieve the sound scenes illustrated in FIGS. 13B-13D respectively;

DEFINITIONS

Figure 1A:
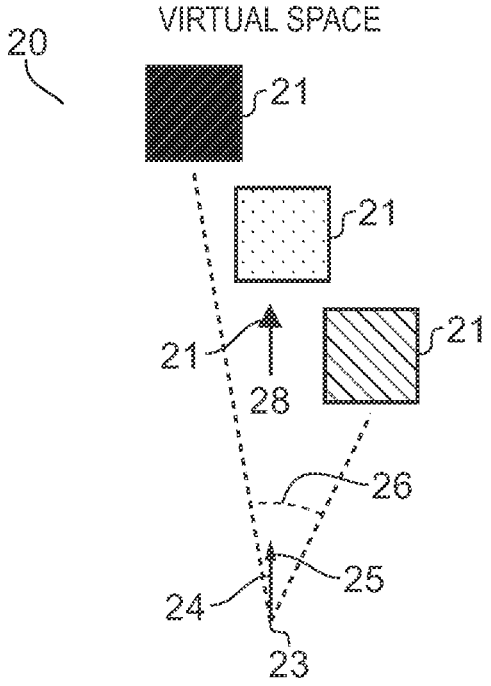

"artificial environment" is something that has been recorded or generated.

"virtual visual space" refers to fully or partially artificial environment that may be viewed, which may be three dimensional.

"virtual visual scene" refers to a representation of the virtual visual space viewed from a particular point of view within the virtual visual space.

'virtual visual object' is a visible virtual object within a virtual visual scene.

"real space" refers to a real environment, which may be three dimensional.

"real visual scene" refers to a representation of the real space viewed from a particular point of view within the real space.

"mediated reality" in this document refers to a user visually experiencing a fully or partially artificial environment (a virtual visual space) as a virtual visual scene at least partially displayed by an apparatus to a user. The virtual visual scene is determined by a point of view within the virtual visual space and a field of view. Displaying the virtual visual scene means providing it in a form that can be seen by the user.

"augmented reality" in this document refers to a form of mediated reality in which a user visually experiences a partially artificial environment (a virtual visual space) as a virtual visual scene comprising a real visual scene of a physical real world environment (real space) supplemented by one or more visual elements displayed by an apparatus to a user;

"virtual reality" in this document refers to a form of mediated reality in which a user visually experiences a fully artificial environment (a virtual visual space) as a virtual visual scene displayed by an apparatus to a user;

"perspective-mediated" as applied to mediated reality, augmented reality or virtual reality means that user actions determine the point of view within the virtual visual space, changing the virtual visual scene;

"first person perspective-mediated" as applied to mediated reality, augmented reality or virtual reality means perspective mediated with the additional constraint that the user's real point of view determines the point of view within the virtual visual space;

"third person perspective-mediated" as applied to mediated reality, augmented reality or virtual reality means perspective mediated with the additional constraint that the user's real point of view does not determine the point of view within the virtual visual space;

"user interactive" as applied to mediated reality, augmented reality or virtual reality means that user actions at least partially determine what happens within the virtual visual space;

"displaying" means providing in a form that is perceived visually (viewed) by the user.

"rendering" means providing in a form that is perceived by the user "sound space" refers to an arrangement of sound sources in a three-dimensional space. A sound space may be defined in relation to recording sounds (a recorded sound space) and in relation to rendering sounds (a rendered sound space).

"sound scene" refers to a representation of the sound space listened to from a particular point of view within the sound space.

"sound object" refers to sound that may be located within the sound space. A source sound object represents a sound source within the sound space. A recorded sound object represents sounds recorded at a particular microphone or position. A rendered sound object represents sounds rendered from a particular position.

"Correspondence" or "corresponding" when used in relation to a sound space and a virtual visual space means that the sound space and virtual visual space are time and space aligned, that is they are the same space at the same time.

"Correspondence" or "corresponding" when used in relation to a sound scene and a virtual visual scene (or visual scene) means that the sound space and virtual visual space (or visual scene) are corresponding and a notional listener whose point of view defines the sound scene and a notional viewer whose point of view defines the virtual visual scene (or visual scene) are at the same position and orientation, that is they have the same point of view.

"virtual space" may mean a virtual visual space, mean a sound space or mean a combination of a virtual visual space and corresponding sound space.

"virtual scene" may mean a virtual visual scene, mean a sound scene or mean a combination of a virtual visual scene and corresponding sound scene.

'virtual object' is an object within a virtual scene, it may be an artificial virtual object (e.g. a computer-generated virtual object) or it may be an image of a real object in a real space that is live or recorded. It may be a sound object and/or a virtual visual object.

DESCRIPTION

FIGS. 1A-1C and 2A-2C illustrate examples of mediated reality. The mediated reality may be augmented reality or virtual reality.

Figure 1B:
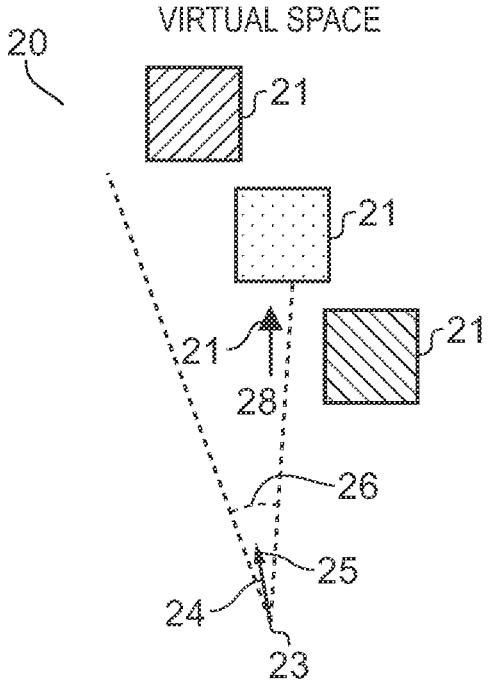
Figure 1C:
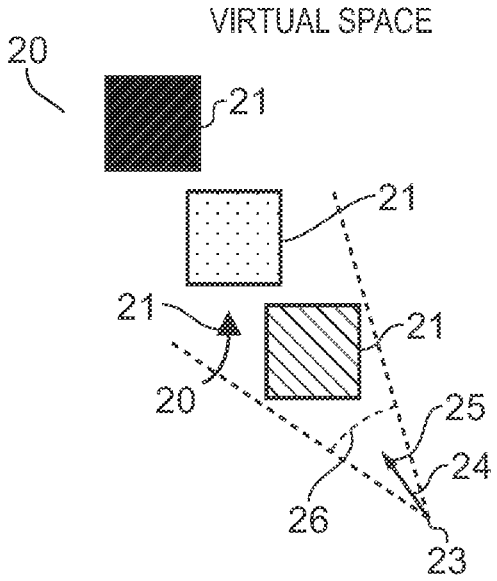

FIGS. 1A, 1B, 1C illustrate the same virtual visual space 20 comprising the same virtual visual objects 21, however, each Fig illustrates a different point of view 24. The position and direction of a point of view 24 can change independently. The direction but not the position of the point of view 24 changes from FIG. 1A to FIG. 1B. The direction and the position of the point of view 24 changes from FIG. 1B to FIG. 1C.

Figure 2A:
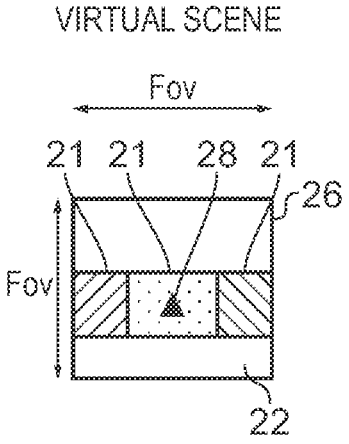
Figure 2B:
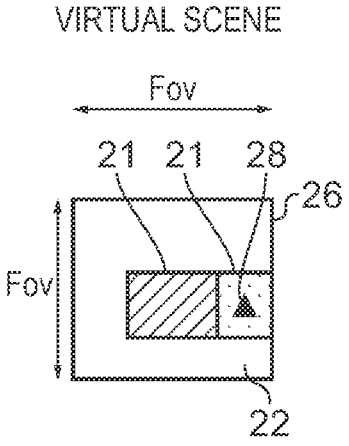
Figure 2C:
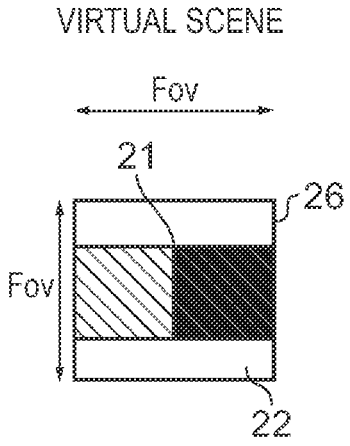

FIGS. 2A, 2B, 2C illustrate a virtual visual scene 22 from the perspective of the different points of view 24 of respective FIGS. 1A, 1B, 1C. The virtual visual scene 22 is determined by the point of view 24 within the virtual visual space 20 and a field of view 26. The virtual visual scene 22 is at least partially displayed to a user.

The virtual visual scenes 22 illustrated may be mediated reality scenes, virtual reality scenes or augmented reality scenes. A virtual reality scene displays a fully artificial virtual visual space 20. An augmented reality scene displays a partially artificial, partially real virtual visual space 20.

The mediated reality, augmented reality or virtual reality may be user interactive-mediated. In this case, user actions at least partially determine what happens within the virtual visual space 20. This may enable interaction with a virtual object 21 such as a visual element 28 within the virtual visual space 20.

The mediated reality, augmented reality or virtual reality may be perspective-mediated. In this case, user actions determine the point of view 24 within the virtual visual space 20, changing the virtual visual scene 22. For example, as illustrated in FIGS. 1A, 1B, 1C a position 23 of the point of view 24 within the virtual visual space 20 may be changed and/or a direction or orientation 25 of the point of view 24 within the virtual visual space 20 may be changed. If the virtual visual space 20 is three-dimensional, the position 23 of the point of view 24 has three degrees of freedom e.g. up/down, forward/back, left/right and the direction 25 of the point of view 24 within the virtual visual space 20 has three degrees of freedom e.g. roll, pitch, yaw. The point of view 24 may be continuously variable in position 23 and/or direction 25 and user action then changes the position and/or direction of the point of view 24 continuously. Alternatively, the point of view 24 may have discrete quantised positions 23 and/or discrete quantised directions 25 and user action switches by discretely jumping between the allowed positions 23 and/or directions 25 of the point of view 24.

Figure 3A:
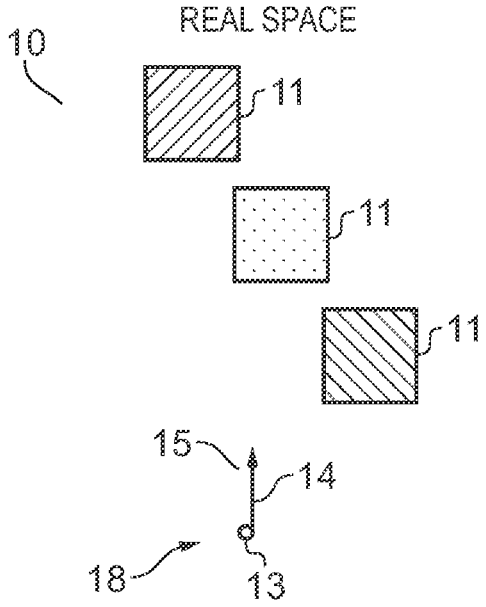
FIG. 3A illustrates an example of a real space and FIG. 3B illustrates an example of a real visual scene that partially corresponds with the virtual visual scene of FIG. 1B.

FIG. 3A illustrates a real space 10 comprising real objects 11 that partially corresponds with the virtual visual space 20 of FIG. 1A. In this example, each real object 11 in the real space 10 has a corresponding virtual object 21 in the virtual visual space 20, however, each virtual object 21 in the virtual visual space 20 does not have a corresponding real object 11 in the real space 10. In this example, one of the virtual objects 21, the computer-generated visual element 28, is an artificial virtual object 21 that does not have a corresponding real object 11 in the real space 10.

A linear mapping may exist between the real space 10 and the virtual visual space 20 and the same mapping exists between each real object 11 in the real space 10 and its corresponding virtual object 21. The relative relationship of the real objects 11 in the real space 10 is therefore the same as the relative relationship between the corresponding virtual objects 21 in the virtual visual space 20.

Figure 3B:
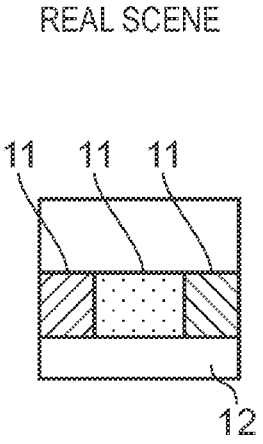

FIG. 3B illustrates a real visual scene 12 that partially corresponds with the virtual visual scene 22 of FIG. 1B, it includes real objects 11 but not artificial virtual objects. The real visual scene is from a perspective corresponding to the point of view 24 in the virtual visual space 20 of FIG. 1A. The real visual scene 12 content is determined by that corresponding point of view 24 and the field of view 26 in virtual space 20 (point of view 14 in real space 10).

FIG. 2A may be an illustration of an augmented reality version of the real visual scene 12 illustrated in FIG. 3B. The virtual visual scene 22 comprises the real visual scene 12 of the real space 10 supplemented by one or more visual elements 28 displayed by an apparatus to a user. The visual elements 28 may be a computer-generated visual element. In a see-through arrangement, the virtual visual scene 22 comprises the actual real visual scene 12 which is seen through a display of the supplemental visual element(s) 28. In a see-video arrangement, the virtual visual scene 22 comprises a displayed real visual scene 12 and displayed supplemental visual element(s) 28. The displayed real visual scene 12 may be based on an image from a single point of view 24 or on multiple images from different points of view 24 at the same time, processed to generate an image from a single point of view 24.

Figure 4:
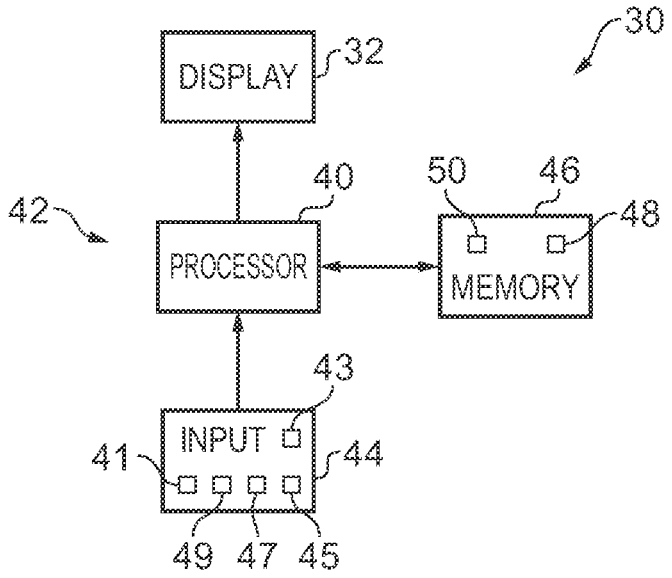
FIG. 4 illustrates an example of an apparatus that is operable to enable mediated reality and/or augmented reality and/or virtual reality.

FIG. 4 illustrates an example of an apparatus 30 that is operable to enable mediated reality and/or augmented reality and/or virtual reality.

The apparatus 30 comprises a display 32 for providing at least parts of the virtual visual scene 22 to a user in a form that is perceived visually by the user. The display 32 may be a visual display that provides light that displays at least parts of the virtual visual scene 22 to a user. Examples of visual displays include liquid crystal displays, organic light emitting displays, emissive, reflective, transmissive and transflective displays, direct retina projection display, near eye displays etc.

The display 32 is controlled in this example but not necessarily all examples by a controller 42.

Implementation of a controller 42 may be as controller circuitry. The controller 42 may be implemented in hardware alone, have certain aspects in software including firmware alone or can be a combination of hardware and software (including firmware).

As illustrated in FIG. 4 the controller 42 may be implemented using instructions that enable hardware functionality, for example, by using executable computer program instructions 48 in a general-purpose or special-purpose processor 40 that may be stored on a computer readable storage medium (disk, memory etc) to be executed by such a processor 40.

The processor 40 is configured to read from and write to the memory 46. The processor 40 may also comprise an output interface via which data and/or commands are output by the processor 40 and an input interface via which data and/or commands are input to the processor 40.

The memory 46 stores a computer program 48 comprising computer program instructions (computer program code) that controls the operation of the apparatus 30 when loaded into the processor 40. The computer program instructions, of the computer program 48, provide the logic and routines that enables the apparatus to perform the methods illustrated in FIGS. 5A & 5B. The processor 40 by reading the memory 46 is able to load and execute the computer program 48.

Figure 5A:
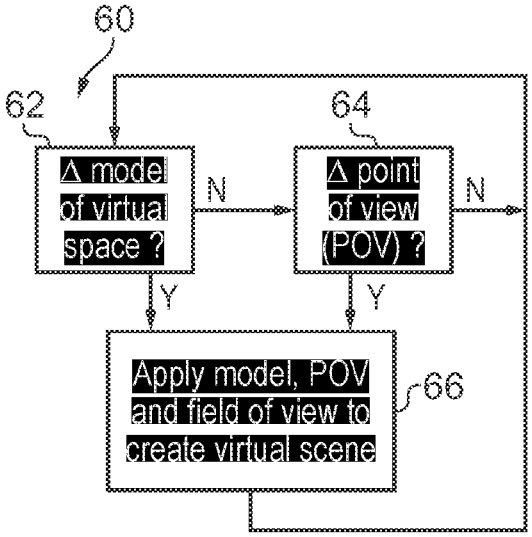
FIG. 5A illustrates an example of a method for enabling mediated reality and/or augmented reality and/or virtual reality.
Figure 5B:
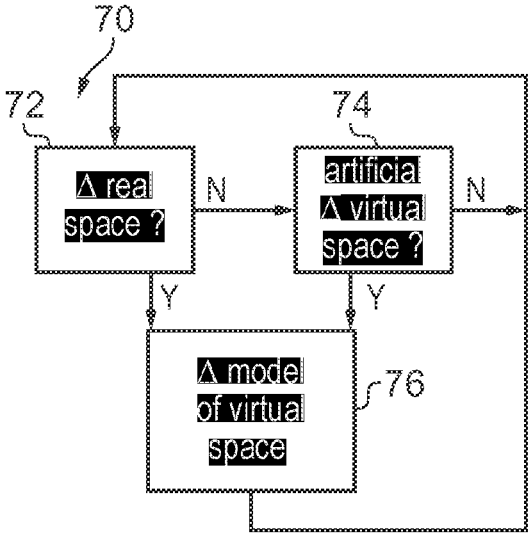
FIG. 5B illustrates an example of a method for updating a model of the virtual visual space for augmented reality.

The blocks illustrated in the FIGS. 5A & 5B may represent steps in a method and/or sections of code in the computer program 48. The illustration of a particular order to the blocks does not necessarily imply that there is a required or preferred order for the blocks and the order and arrangement of the block may be varied. Furthermore, it may be possible for some blocks to be omitted.

The apparatus 30 may enable mediated reality and/or augmented reality and/or virtual reality, for example using the method 60 illustrated in FIG. 5A or a similar method. The controller 42 stores and maintains a model 50 of the virtual visual space 20. The model may be provided to the controller 42 or determined by the controller 42. For example, sensors in input circuitry 44 may be used to create overlapping depth maps of the virtual visual space from different points of view and a three dimensional model may then be produced.

There are many different technologies that may be used to create a depth map. An example of a passive system, used in the Kinect™ device, is when an object is painted with a non-homogenous pattern of symbols using infrared light and the reflected light is measured using multiple cameras and then processed, using the parallax effect, to determine a position of the object.

At block 62 it is determined whether or not the model of the virtual visual space 20 has changed. If the model of the virtual visual space 20 has changed the method moves to block 66. If the model of the virtual visual space 20 has not changed the method moves to block 64.

At block 64 it is determined whether or not the point of view 24 in the virtual visual space 20 has changed. If the point of view 24 has changed the method moves to block 66. If the point of view 24 has not changed the method returns to block 62.

At block 66, a two-dimensional projection of the three-dimensional virtual visual space 20 is taken from the location 23 and in the direction 25 defined by the current point of view 24. The projection is then limited by the field of view 26 to produce the virtual visual scene 22. The method then returns to block 62.

Where the apparatus 30 enables augmented reality, the virtual visual space 20 comprises objects 11 from the real space 10 and also visual elements 28 not present in the real space 10. The combination of such visual elements 28 may be referred to as the artificial virtual visual space. FIG. 5B illustrates a method 70 for updating a model of the virtual visual space 20 for augmented reality.

At block 72 it is determined whether or not the real space 10 has changed. If the real space 10 has changed the method moves to block 76. If the real space 10 has not changed the method moves to block 74. Detecting a change in the real space 10 may be achieved at a pixel level using differencing and may be achieved at an object level using computer vision to track objects as they move.

At block 74 it is determined whether or not the artificial virtual visual space has changed. If the artificial virtual visual space has changed the method moves to block 76. If the artificial virtual visual space has not changed the method returns to block 72. As the artificial virtual visual space is generated by the controller 42 changes to the visual elements 28 are easily detected.

At block 76, the model of the virtual visual space 20 is updated.

The apparatus 30 may enable user-interactive mediation for mediated reality and/or augmented reality and/or virtual reality. The user input circuitry 44 detects user actions using user input 43. These user actions are used by the controller 42 to determine what happens within the virtual visual space 20. This may enable interaction with a visual element 28 within the virtual visual space 20.

The apparatus 30 may enable perspective mediation for mediated reality and/or augmented reality and/or virtual reality. The user input circuitry 44 detects user actions. These user actions are used by the controller 42 to determine the point of view 24 within the virtual visual space 20, changing the virtual visual scene 22. The point of view 24 may be continuously variable in position and/or direction and user action changes the position and/or direction of the point of view 24. Alternatively, the point of view 24 may have discrete quantised positions and/or discrete quantised directions and user action switches by jumping to the next position and/or direction of the point of view 24.

The apparatus 30 may enable first person perspective for mediated reality, augmented reality or virtual reality. The user input circuitry 44 detects the user's real point of view 14 using user point of view sensor 45. The user's real point of view is used by the controller 42 to determine the point of view 24 within the virtual visual space 20, changing the virtual visual scene 22. Referring back to FIG. 3A, a user 18 has a real point of view 14. The real point of view may be changed by the user 18. For example, a real location 13 of the real point of view 14 is the location of the user 18 and can be changed by changing the physical location 13 of the user 18. For example, a real direction 15 of the real point of view 14 is the direction in which the user 18 is looking and can be changed by changing the real direction of the user 18. The real direction 15 may, for example, be changed by a user 18 changing an orientation of their head or view point and/or a user changing a direction of their gaze. A head-mounted apparatus 30 may be used to enable first-person perspective mediation by measuring a change in orientation of the user's head and/or a change in the user's direction of gaze.

In some but not necessarily all examples, the apparatus 30 comprises as part of the input circuitry 44 point of view sensors 45 for determining changes in the real point of view.

For example, positioning technology such as GPS, triangulation (trilateration) by transmitting to multiple receivers and/or receiving from multiple transmitters, acceleration detection and integration may be used to determine a new physical location 13 of the user 18 and real point of view 14.

For example, accelerometers, electronic gyroscopes or electronic compasses may be used to determine a change in an orientation of a user's head or view point and a consequential change in the real direction 15 of the real point of view 14.

For example, pupil tracking technology, based for example on computer vision, may be used to track movement of a user's eye or eyes and therefore determine a direction of a user's gaze and consequential changes in the real direction 15 of the real point of view 14.

The apparatus 30 may comprise as part of the input circuitry 44 image sensors 47 for imaging the real space 10.

An example of an image sensor 47 is a digital image sensor that is configured to operate as a camera. Such a camera may be operated to record static images and/or video images In some, but not necessarily all embodiments, cameras may be configured in a stereoscopic or other spatially distributed arrangement so that the real space 10 is viewed from different perspectives. This may enable the creation of a three-dimensional image and/or processing to establish depth, for example, via the parallax effect.

In some, but not necessarily all embodiments, the input circuitry 44 comprises depth sensors 49. A depth sensor 49 may comprise a transmitter and a receiver. The transmitter transmits a signal (for example, a signal a human cannot sense such as ultrasound or infrared light) and the receiver receives the reflected signal. Using a single transmitter and a single receiver some depth information may be achieved via measuring the time of flight from transmission to reception. Better resolution may be achieved by using more transmitters and/or more receivers (spatial diversity). In one example, the transmitter is configured to 'paint' the real space 10 with light, preferably invisible light such as infrared light, with a spatially dependent pattern. Detection of a certain pattern by the receiver allows the real space 10 to be spatially resolved. The distance to the spatially resolved portion of the real space 10 may be determined by time of flight and/or stereoscopy (if the receiver is in a stereoscopic position relative to the transmitter).

In some but not necessarily all embodiments, the input circuitry 44 may comprise communication circuitry 41 in addition to or as an alternative to one or more of the image sensors 47 and the depth sensors 49. Such communication circuitry 41 may communicate with one or more remote image sensors 47 in the real space 10 and/or with remote depth sensors 49 in the real space 10.

Figure 6A:
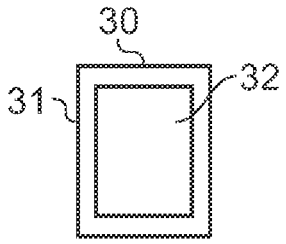
FIGS. 6A and 6B illustrate examples of apparatus that enable display of at least parts of the virtual visual scene to a user.
Figure 6B:
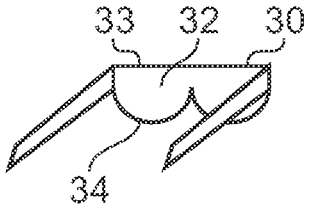

FIGS. 6A and 6B illustrate examples of apparatus 30 that enable display of at least parts of the virtual visual scene 22 to a user.

FIG. 6A illustrates a handheld apparatus 31 comprising a display screen as display 32 that displays images to a user and is used for displaying the virtual visual scene 22 to the user. The apparatus 30 may be moved deliberately in the hands of a user in one or more of the previously mentioned six degrees of freedom. The handheld apparatus 31 may house the sensors 45 for determining changes in the real point of view from a change in orientation of the apparatus 30.

The handheld apparatus 31 may be or may be operated as a see-video arrangement for augmented reality that enables a live or recorded video of a real visual scene 12 to be displayed on the display 32 for viewing by the user while one or more visual elements 28 are simultaneously displayed on the display 32 for viewing by the user. The combination of the displayed real visual scene 12 and displayed one or more visual elements 28 provides the virtual visual scene 22 to the user.

If the handheld apparatus 31 has a camera mounted on a face opposite the display 32, it may be operated as a see-video arrangement that enables a live real visual scene 12 to be viewed while one or more visual elements 28 are displayed to the user to provide in combination the virtual visual scene 22.

FIG. 6B illustrates a head-mounted apparatus 33 comprising a display 32 that displays images to a user. The head-mounted apparatus 33 may be moved automatically when a head of the user moves. The head-mounted apparatus 33 may house the sensors 45 for gaze direction detection and/or selection gesture detection.

The head-mounted apparatus 33 may be a see-through arrangement for augmented reality that enables a live real visual scene 12 to be viewed while one or more visual elements 28 are displayed by the display 32 to the user to provide in combination the virtual visual scene 22. In this case a visor 34, if present, is transparent or semi-transparent so that the live real visual scene 12 can be viewed through the visor 34.

The head-mounted apparatus 33 may be operated as a see-video arrangement for augmented reality that enables a live or recorded video of a real visual scene 12 to be displayed by the display 32 for viewing by the user while one or more visual elements 28 are simultaneously displayed by the display 32 for viewing by the user. The combination of the displayed real visual scene 12 and displayed one or more visual elements 28 provides the virtual visual scene 22 to the user. In this case a visor 34 is opaque and may be used as display 32.

Other examples of apparatus 30 that enable display of at least parts of the virtual visual scene 22 to a user may be used.

For example, one or more projectors may be used that project one or more visual elements to provide augmented reality by supplementing a real visual scene of a physical real world environment (real space).

For example, multiple projectors or displays may surround a user to provide virtual reality by presenting a fully artificial environment (a virtual visual space) as a virtual visual scene to the user.

Referring back to FIG. 4, an apparatus 30 may enable user-interactive mediation for mediated reality and/or augmented reality and/or virtual reality. The user input circuitry 44 detects user actions using user input 43. These user actions are used by the controller 42 to determine what happens within the virtual visual space 20. This may enable interaction with a visual element 28 within the virtual visual space 20.

The detected user actions may, for example, be gestures performed in the real space 10. Gestures may be detected in a number of ways. For example, depth sensors 49 may be used to detect movement of parts a user 18 and/or or image sensors 47 may be used to detect movement of parts of a user 18 and/or positional/movement sensors attached to a limb of a user 18 may be used to detect movement of the limb.

Object tracking may be used to determine when an object or user changes. For example, tracking the object on a large macro-scale allows one to create a frame of reference that moves with the object. That frame of reference can then be used to track time-evolving changes of shape of the object, by using temporal differencing with respect to the object. This can be used to detect small scale human motion such as gestures, hand movement, finger movement, facial movement. These are scene independent user (only) movements relative to the user.

The apparatus 30 may track a plurality of objects and/or points in relation to a user's body, for example one or more joints of the user's body. In some examples, the apparatus 30 may perform full body skeletal tracking of a user's body. In some examples, the apparatus 30 may perform digit tracking of a user's hand.

The tracking of one or more objects and/or points in relation to a user's body may be used by the apparatus 30 in gesture recognition.

Figure 7A:
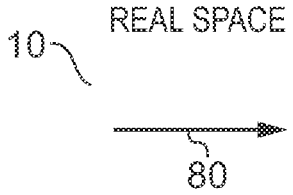
FIG. 7A, illustrates an example of a gesture in real space

Referring to FIG. 7A, a particular gesture 80 in the real space 10 is a gesture user input used as a 'user control' event by the controller 42 to determine what happens within the virtual visual space 20. A gesture user input is a gesture 80 that has meaning to the apparatus 30 as a user input.

Figure 7B:
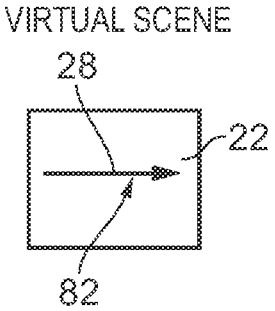
FIG. 7B, illustrates a corresponding representation rendered, in the virtual visual scene, of the gesture in real space.

Referring to FIG. 7B, illustrates that in some but not necessarily all examples, a corresponding representation of the gesture 80 in real space is rendered in the virtual visual scene 22 by the apparatus 30. The representation involves one or more visual elements 28 moving 82 to replicate or indicate the gesture 80 in the virtual visual scene 22.

A gesture 80 may be static or moving. A moving gesture may comprise a movement or a movement pattern comprising a series of movements. For example it could be making a circling motion or a side to side or up and down motion or the tracing of a sign in space. A moving gesture may, for example, be an apparatus-independent gesture or an apparatus-dependent gesture. A moving gesture may involve movement of a user input object e.g. a user body part or parts, or a further apparatus, relative to the sensors. The body part may comprise the user's hand or part of the user's hand such as one or more fingers and thumbs. In other examples, the user input object may comprise a different part of the body of the user such as their head or arm. Three-dimensional movement may comprise motion of the user input object in any of six degrees of freedom. The motion may comprise the user input object moving towards or away from the sensors as well as moving in a plane parallel to the sensors or any combination of such motion.

A gesture 80 may be a non-contact gesture. A non-contact gesture does not contact the sensors at any time during the gesture.

A gesture 80 may be an absolute gesture that is defined in terms of an absolute displacement from the sensors. Such a gesture may be tethered, in that it is performed at a precise location in the real space 10. Alternatively a gesture 80 may be a relative gesture that is defined in terms of relative displacement during the gesture. Such a gesture may be un-tethered, in that it need not be performed at a precise location in the real space 10 and may be performed at a large number of arbitrary locations.

A gesture 80 may be defined as evolution of displacement, of a tracked point relative to an origin, with time. It may, for example, be defined in terms of motion using time variable parameters such as displacement, velocity or using other kinematic parameters. An un-tethered gesture may be defined as evolution of relative displacement $\Delta d$ with relative time $\Delta t$.

A gesture 80 may be performed in one spatial dimension (1D gesture), two spatial dimensions (2D gesture) or three spatial dimensions (3D gesture).

Figure 8:
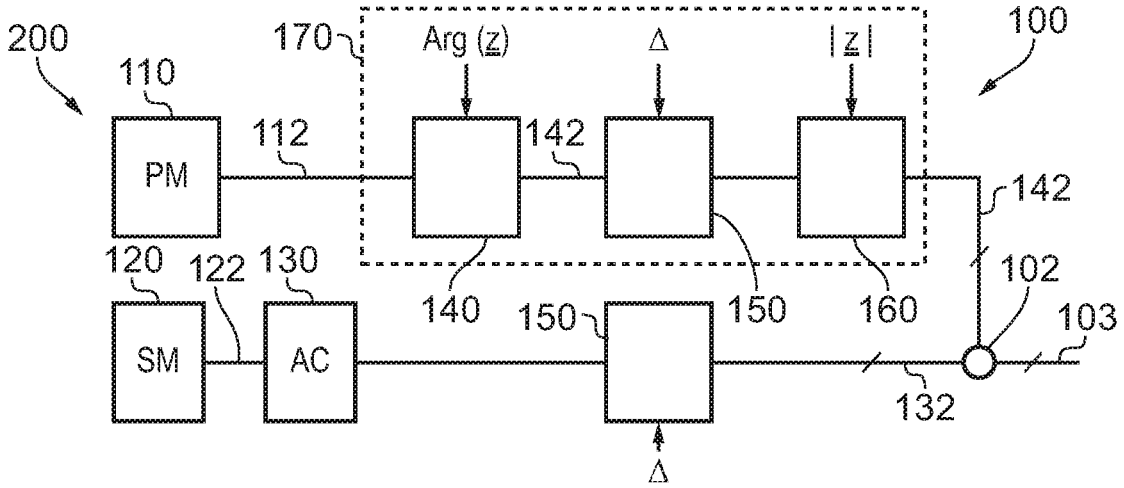
FIG. 8 illustrates an example of a system for modifying a rendered sound scene.

FIG. 8 illustrates an example of a system 100 and also an example of a method 200. The system 100 and method 200 record a sound space and process the recorded sound space to enable a rendering of the recorded sound space as a rendered sound scene for a listener at a particular position (the origin) and orientation within the sound space.

A sound space is an arrangement of sound sources in a three-dimensional space. A sound space may be defined in relation to recording sounds (a recorded sound space) and in relation to rendering sounds (a rendered sound space).

The system 100 comprises one or more portable microphones 110 and may comprise one or more static microphones 120.

In this example, but not necessarily all examples, the origin of the sound space is at a microphone. In this example, the microphone at the origin is a static microphone 120. It may record one or more channels, for example it may be a microphone array. However, the origin may be at any arbitrary position.

In this example, only a single static microphone 120 is illustrated. However, in other examples multiple static microphones 120 may be used independently.

The system 100 comprises one or more portable microphones 110. The portable microphone 110 may, for example, move with a sound source within the recorded sound space. The portable microphone may, for example, be an 'up-close' microphone that remains close to a sound source. This may be achieved, for example, using a boom microphone or, for example, by attaching the microphone to the sound source, for example, by using a Lavalier microphone. The portable microphone 110 may record one or more recording channels.

The relative position of the portable microphone PM 110 from the origin may be represented by the vector z. The vector z therefore positions the portable microphone 110 relative to a notional listener of the recorded sound space.

The relative orientation of the notional listener at the origin may be represented by the value A. The orientation value A defines the notional listener's 'point of view' which defines the sound scene. The sound scene is a representation of the sound space listened to from a particular point of view within the sound space.

When the sound space as recorded is rendered to a user (listener) via the system 100 in FIG. 1, it is rendered to the listener as if the listener is positioned at the origin of the recorded sound space with a particular orientation. It is therefore important that, as the portable microphone 110 moves in the recorded sound space, its position z relative to the origin of the recorded sound space is tracked and is correctly represented in the rendered sound space. The system 100 is configured to achieve this.

The audio signals 122 output from the static microphone 120 are coded by audio coder 130 into a multichannel audio signal 132. If multiple static microphones were present, the output of each would be separately coded by an audio coder into a multichannel audio signal.

The audio coder 130 may be a spatial audio coder such that the multichannel audio signals 132 represent the sound space as recorded by the static microphone 120 and can be rendered giving a spatial audio effect. For example, the audio coder 130 may be configured to produce multichannel audio signals 132 according to a defined standard such as, for example, binaural coding, 5.1 surround sound coding, 7.1 surround sound coding etc. If multiple static microphones were present, the multichannel signal of each static microphone would be produced according to the same defined standard such as, for example, binaural coding, 5.1 surround sound coding, and 7.1 surround sound coding and in relation to the same common rendered sound space.

The multichannel audio signals 132 from one or more the static microphones 120 are mixed by mixer 102 with multichannel audio signals 142 from the one or more portable microphones 110 to produce a multi-microphone multichannel audio signal 103 that represents the recorded sound scene relative to the origin and which can be rendered by an audio decoder corresponding to the audio coder 130 to reproduce a rendered sound scene to a listener that corresponds to the recorded sound scene when the listener is at the origin.

The multichannel audio signal 142 from the, or each, portable microphone 110 is processed before mixing to take account of any movement of the portable microphone 110 relative to the origin at the static microphone 120.

The audio signals 112 output from the portable microphone 110 are processed by the positioning block 140 to adjust for movement of the portable microphone 110 relative to the origin. The positioning block 140 takes as an input the vector z or some parameter or parameters dependent upon the vector z. The vector z represents the relative position of the portable microphone 110 relative to the origin.

The positioning block 140 may be configured to adjust for any time misalignment between the audio signals 112 recorded by the portable microphone 110 and the audio signals 122 recorded by the static microphone 120 so that they share a common time reference frame. This may be achieved, for example, by correlating naturally occurring or artificially introduced (non-audible) audio signals that are present within the audio signals 112 from the portable microphone 110 with those within the audio signals 122 from the static microphone 120. Any timing offset identified by the correlation may be used to delay/advance the audio signals 112 from the portable microphone 110 before processing by the positioning block 140.

The positioning block 140 processes the audio signals 112 from the portable microphone 110, taking into account the relative orientation (Arg(z)) of that portable microphone 110 relative to the origin at the static microphone 120.

The audio coding of the static microphone audio signals 122 to produce the multichannel audio signal 132 assumes a particular orientation of the rendered sound space relative to an orientation of the recorded sound space and the audio signals 122 are encoded to the multichannel audio signals 132 accordingly.

The relative orientation Arg (z) of the portable microphone 110 in the recorded sound space is determined and the audio signals 112 representing the sound object are coded to the multichannels defined by the audio coding 130 such that the sound object is correctly oriented within the rendered sound space at a relative orientation Arg (z) from the listener. For example, the audio signals 112 may first be mixed or encoded into the multichannel signals 142 and then a transformation T may be used to rotate the multichannel audio signals 142, representing the moving sound object, within the space defined by those multiple channels by Arg (z).

An orientation block 150 may be used to rotate the multichannel audio signals 142 by Δ, if necessary. Similarly, an orientation block 150 may be used to rotate the multichannel audio signals 132 by Δ, if necessary.

The functionality of the orientation block 150 is very similar to the functionality of the orientation function of the positioning block 140 except it rotates by Δ instead of Arg(z).

In some situations, for example when the sound scene is rendered to a listener through a head-mounted audio output device 300, for example headphones using binaural audio coding, it may be desirable for the rendered sound space 310 to remain fixed in space 320 when the listener turns their head 330 in space. This means that the rendered sound space 310 needs to be rotated relative to the audio output device 300 by the same amount in the opposite sense to the head rotation. The orientation of the rendered sound space 310 tracks with the rotation of the listener's head so that the orientation of the rendered sound space 310 remains fixed in space 320 and does not move with the listener's head 330.

The portable microphone signals 112 are additionally processed to control the perception of the distance D of the sound object from the listener in the rendered sound scene, for example, to match the distance |z| of the sound object from the origin in the recorded sound space. This can be useful when binaural coding is used so that the sound object is, for example, externalized from the user and appears to be at a distance rather than within the user's head, between the user's ears. The distance block 160 processes the multichannel audio signal 142 to modify the perception of distance.

Figure 9:
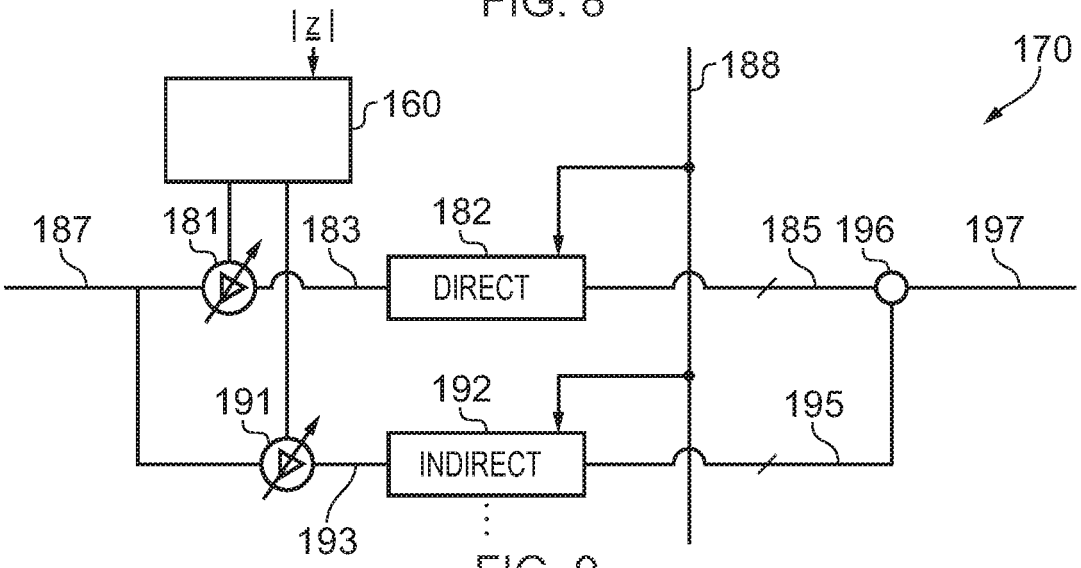
FIG. 9 illustrates an example of a module which may be used, for example, to perform the functions of the positioning block, orientation block and distance block of the system.

FIG. 9 illustrates a module 170 which may be used, for example, to perform the method 200 and/or functions of the positioning block 140, orientation block 150 and distance block 160 in FIG. 8. The module 170 may be implemented using circuitry and/or programmed processors.

The Figure illustrates the processing of a single channel of the multichannel audio signal 142 before it is mixed with the multichannel audio signal 132 to form the multi-microphone multichannel audio signal 103. A single input channel of the multichannel signal 142 is input as signal 187.

The input signal 187 passes in parallel through a "direct" path and one or more "indirect" paths before the outputs from the paths are mixed together, as multichannel signals, by mixer 196 to produce the output multichannel signal 197. The output multichannel signal 197, for each of the input channels, are mixed to form the multichannel audio signal 142 that is mixed with the multichannel audio signal 132.

The direct path represents audio signals that appear, to a listener, to have been received directly from an audio source and an indirect path represents audio signals that appear to a listener to have been received from an audio source via an indirect path such as a multipath or a reflected path or a refracted path.

The distance block 160 by modifying the relative gain between the direct path and the indirect paths, changes the perception of the distance D of the sound object from the listener in the rendered sound space 310.

Each of the parallel paths comprises a variable gain device 181, 191 which is controlled by the distance block 160.

The perception of distance can be controlled by controlling relative gain between the direct path and the indirect (decorrelated) paths. Increasing the indirect path gain relative to the direct path gain increases the perception of distance.

In the direct path, the input signal 187 is amplified by variable gain device 181, under the control of the distance block 160, to produce a gain-adjusted signal 183. The gain-adjusted signal 183 is processed by a direct processing module 182 to produce a direct multichannel audio signal 185.

In the indirect path, the input signal 187 is amplified by variable gain device 191, under the control of the distance block 160, to produce a gain-adjusted signal 193. The gain-adjusted signal 193 is processed by an indirect processing module 192 to produce an indirect multichannel audio signal 195.

The direct multichannel audio signal 185 and the one or more indirect multichannel audio signals 195 are mixed in the mixer 196 to produce the output multichannel audio signal 197.

The direct processing block 182 and the indirect processing block 192 both receive direction of arrival signals 188. The direction of arrival signal 188 gives the orientation Arg(z) of the portable microphone 110 (moving sound object) in the recorded sound space and the orientation Δ of the rendered sound space 310 relative to the notional listener/audio output device 300.

The position of the moving sound object changes as the portable microphone 110 moves in the recorded sound space and the orientation of the rendered sound space changes as a head-mounted audio output device rendering the sound space rotates.

The direct processing block 182 may, for example, include a system 184 that rotates the single channel audio signal, gain-adjusted input signal 183, in the appropriate multichannel space producing the direct multichannel audio signal 185. The system uses a transfer function to performs a transformation T that rotates multichannel signals within the space defined for those multiple channels by Arg(z) and by Δ, defined by the direction of arrival signal 188. For example, a head related transfer function (HRTF) interpolator may be used for binaural audio. As another example, Vector Base Amplitude Panning (VBAP) may be used for loudspeaker format (e.g. 5.1) audio.

The indirect processing block 192 may, for example, use the direction of arrival signal 188 to control the gain of the single channel audio signal, the gain-adjusted input signal 193, using a variable gain device 194. The amplified signal is then processed using a static decorrelator 196 and a static transformation T to produce the indirect multichannel audio signal 195. The static decorrelator in this example uses a pre-delay of at least 2 ms. The transformation T rotates multichannel signals within the space defined for those multiple channels in a manner similar to the direct system but by a fixed amount. For example, a static head related transfer function (HRTF) interpolator may be used for binaural audio.

It will therefore be appreciated that the module 170 can be used to process the portable microphone signals 112 and perform the functions of:

(i) changing the relative position (orientation Arg(z) and/or distance |z|) of a rendered sound object, from a listener in the rendered sound space and (ii) changing the orientation of the rendered sound space (including the rendered sound object positioned according to (i)).

It should also be appreciated that the module 170 may also be used for performing the function of the orientation block 150 only, when processing the audio signals 122 provided by the static microphone 120. However, the direction of arrival signal will include only A and will not include Arg(z). In some but not necessarily all examples, gain of the variable gain devices 191 modifying the gain to the indirect paths may be put to zero and the gain of the variable gain device 181 for the direct path may be fixed. In this instance, the module 170 reduces to a system that rotates the recorded sound space to produce the rendered sound space according to a direction of arrival signal that includes only A and does not include Arg(z).

Figure 10:
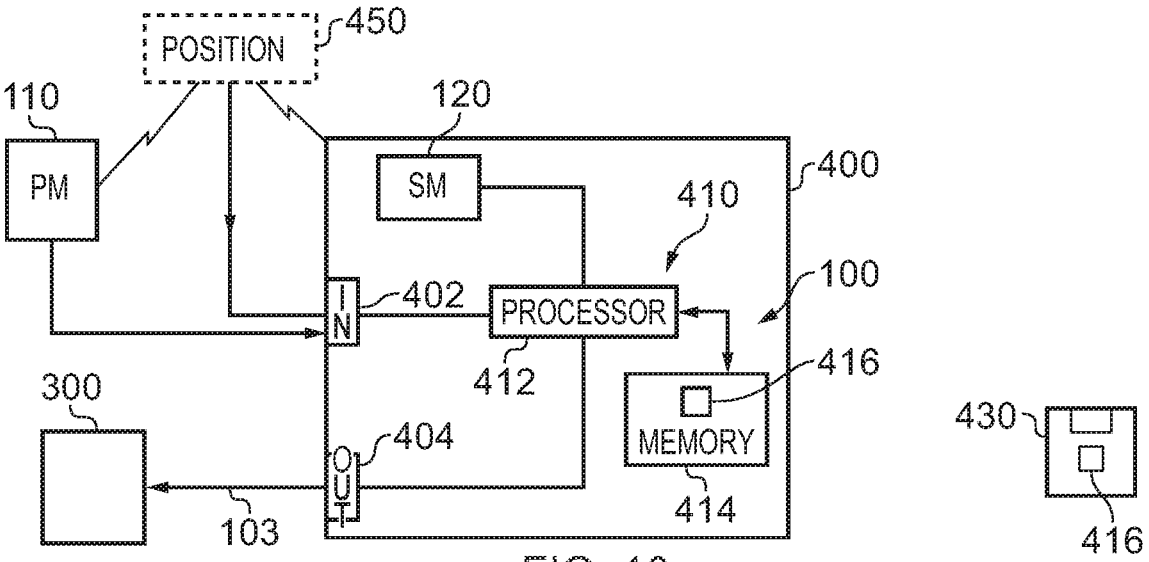
FIG. 10 illustrates an example of the system/module implemented using an apparatus.

FIG. 10 illustrates an example of the system 100 implemented using an apparatus 400. The apparatus 400 may, for example, be a static electronic device, a portable electronic device or a hand-portable electronic device that has a size that makes it suitable to be carried on a palm of a user or in an inside jacket pocket of the user.

In this example, the apparatus 400 comprises the static microphone 120 as an integrated microphone but does not comprise the one or more portable microphones 110 which are remote. In this example, but not necessarily all examples, the static microphone 120 is a microphone array. However, in other examples, the apparatus 400 does not comprise the static microphone 120.

The apparatus 400 comprises an external communication interface 402 for communicating externally with external microphones, for example, the remote portable microphone(s) 110. This may, for example, comprise a radio transceiver.

A positioning system 450 is illustrated as part of the system 100. This positioning system 450 is used to position the portable microphone(s) 110 relative to the origin of the sound space e.g. the static microphone 120. In this example, the positioning system 450 is illustrated as external to both the portable microphone 110 and the apparatus 400. It provides information dependent on the position z of the portable microphone 110 relative to the origin of the sound space to the apparatus 400. In this example, the information is provided via the external communication interface 402, however, in other examples a different interface may be used. Also, in other examples, the positioning system may be wholly or partially located within the portable microphone 110 and/or within the apparatus 400.

The position system 450 provides an update of the position of the portable microphone 110 with a particular frequency and the term 'accurate' and 'inaccurate' positioning of the sound object should be understood to mean accurate or inaccurate within the constraints imposed by the frequency of the positional update. That is accurate and inaccurate are relative terms rather than absolute terms.

The position system 450 enables a position of the portable microphone 110 to be determined. The position system 450 may receive positioning signals and determine a position which is provided to the processor 412 or it may provide positioning signals or data dependent upon positioning signals so that the processor 412 may determine the position of the portable microphone 110.

There are many different technologies that may be used by a position system 450 to position an object including passive systems where the positioned object is passive and does not produce a positioning signal and active systems where the positioned object produces one or more positioning signals. An example of a system, used in the Kinect™ device, is when an object is painted with a non-homogenous pattern of symbols using infrared light and the reflected light is measured using multiple cameras and then processed, using the parallax effect, to determine a position of the object. An example of an active radio positioning system is when an object has a transmitter that transmits a radio positioning signal to multiple receivers to enable the object to be positioned by, for example, trilateration or triangulation. The transmitter may be a Bluetooth tag or a radio-frequency identification (RFID) tag, as an example. An example of a passive radio positioning system is when an object has a receiver or receivers that receive a radio positioning signal from multiple transmitters to enable the object to be positioned by, for example, trilateration or triangulation. Trilateration requires an estimation of a distance of the object from multiple, non-aligned, transmitter/receiver locations at known positions. A distance may, for example, be estimated using time of flight or signal attenuation. Triangulation requires an estimation of a bearing of the object from multiple, non-aligned, transmitter/receiver locations at known positions. A bearing may, for example, be estimated using a transmitter that transmits with a variable narrow aperture, a receiver that receives with a variable narrow aperture, or by detecting phase differences at a diversity receiver.

Other positioning systems may use dead reckoning and inertial movement or magnetic positioning.

The object that is positioned may be the portable microphone 110 or it may an object worn or carried by a person associated with the portable microphone 110 or it may be the person associated with the portable microphone 110.

The apparatus 400 wholly or partially operates the system 100 and method 200 described above to produce a multi-microphone multichannel audio signal 103.

The apparatus 400 provides the multi-microphone multichannel audio signal 103 via an output communications interface 404 to an audio output device 300 for rendering.

In some but not necessarily all examples, the audio output device 300 may use binaural coding. Alternatively or additionally, in some but not necessarily all examples, the audio output device 300 may be a head-mounted audio output device.

In this example, the apparatus 400 comprises a controller 410 configured to process the signals provided by the static microphone 120 and the portable microphone 110 and the positioning system 450. In some examples, the controller 410 may be required to perform analogue to digital conversion of signals received from microphones 110, 120 and/or perform digital to analogue conversion of signals to the audio output device 300 depending upon the functionality at the microphones 110, 120 and audio output device 300. However, for clarity of presentation no converters are illustrated in FIG. 9.

Implementation of a controller 410 may be as controller circuitry. The controller 410 may be implemented in hardware alone, have certain aspects in software including firmware alone or can be a combination of hardware and software (including firmware).

As illustrated in FIG. 10 the controller 410 may be implemented using instructions that enable hardware functionality, for example, by using executable instructions of a computer program 416 in a general-purpose or special-purpose processor 412 that may be stored on a computer readable storage medium (disk, memory etc) to be executed by such a processor 412.

The processor 412 is configured to read from and write to the memory 414. The processor 412 may also comprise an output interface via which data and/or commands are output by the processor 412 and an input interface via which data and/or commands are input to the processor 412.

The memory 414 stores a computer program 416 comprising computer program instructions (computer program code) that controls the operation of the apparatus 400 when loaded into the processor 412. The computer program instructions, of the computer program 416, provide the logic and routines that enables the apparatus to perform the methods illustrated in FIGS. 1-19. The processor 412 by reading the memory 414 is able to load and execute the computer program 416.

The blocks illustrated in the FIGS. 8 and 9 may represent steps in a method and/or sections of code in the computer program 416. The illustration of a particular order to the blocks does not necessarily imply that there is a required or preferred order for the blocks and the order and arrangement of the block may be varied. Furthermore, it may be possible for some blocks to be omitted.

The preceding description describes, in relation to FIGS. 1 to 7, a system, apparatus 30, method 60 and computer program 48 that enables control of a virtual visual space 20 and the virtual visual scene 26 dependent upon the virtual visual space 20.

The preceding description describes. In relation to FIGS. 8 to 10, a system 100, apparatus 400, method 200 and computer program 416 that enables control of a sound space and the sound scene dependent upon the sound space.

The functionality that enables control of a virtual visual space 20 and the virtual visual scene 26 dependent upon the virtual visual space 20 and the functionality that enables control of a sound space and the sound scene dependent upon the sound space may be provided by the same apparatus 30, 400, system 100, method 60, 200 or computer program 48, 416.

In some but not necessarily all examples, the virtual visual space 20 and the sound space may be corresponding. "Correspondence" or "corresponding" when used in relation to a sound space and a virtual visual space means that the sound space and virtual visual space are time and space aligned, that is they are the same space at the same time.

The correspondence between virtual visual space and sound space results in correspondence between the virtual visual scene and the sound scene. "Correspondence" or "corresponding" when used in relation to a sound scene and a virtual visual scene means that the sound space and virtual visual space are corresponding and a notional listener whose point of view defines the sound scene and a notional viewer whose point of view defines the virtual visual scene are at the same position and orientation, that is they have the same point of view.

Figure 11:
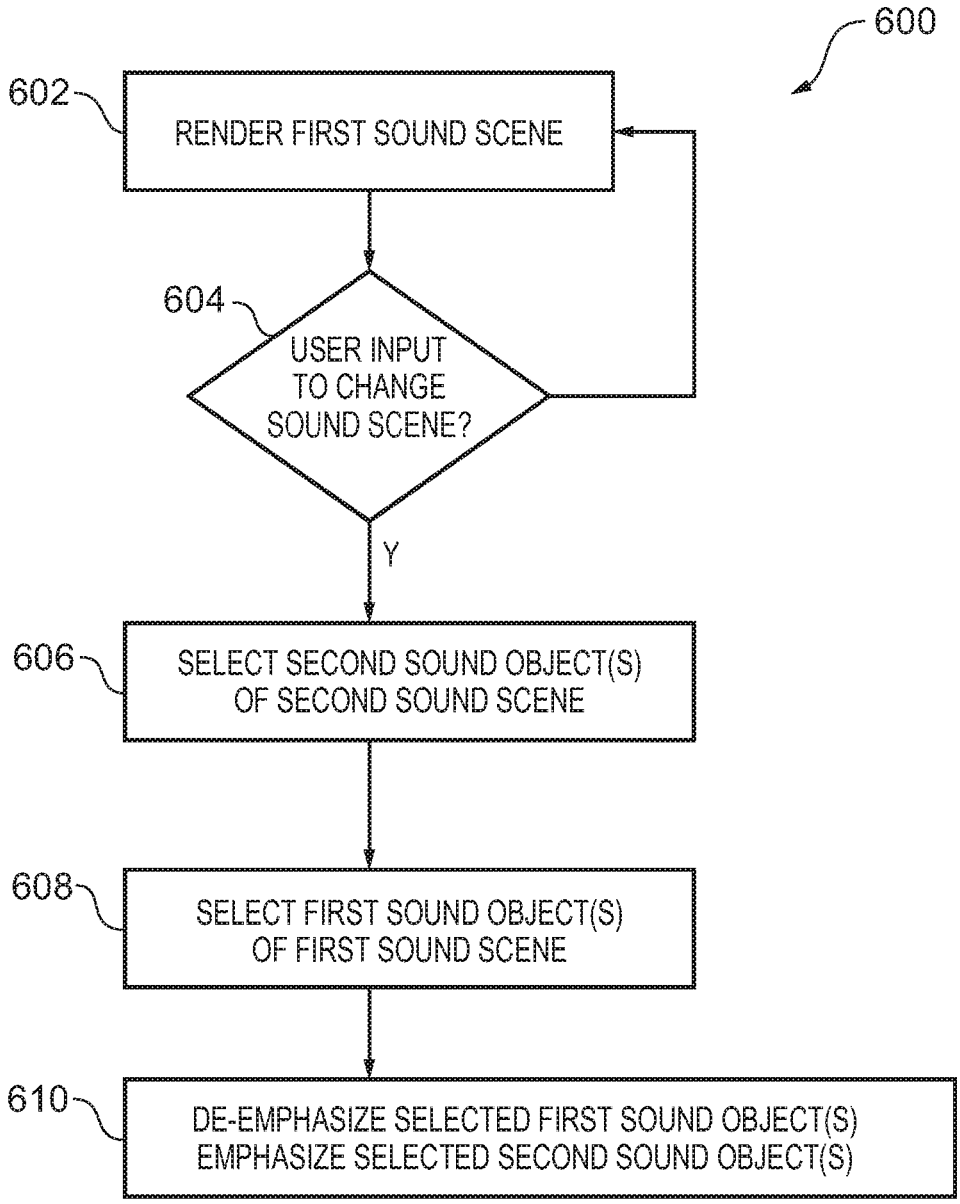
FIG. 11 illustrates an example of the method for rendering a sound scene.

FIG. 11 illustrates an example of the method 600 for rendering a sound scene which will be described in more detail with reference to FIGS. 11 to 19.

At block 602, in FIG. 11, the method 600 comprises causing rendering of a first sound scene 701 comprising multiple first sound objects 711.

At block 604, direct or indirect user specification 720 of a change in sound scene from the first sound scene 701 to a mixed sound scene is detected. If direct or indirect user specification 720 of a change in sound scene from the first sound scene 701 to a mixed sound scene is detected the method moves to block 606. If direct or indirect user specification 720 of a change in sound scene from the first sound scene 701 to a mixed sound scene is not detected the method moves back to block 602.

At block 606, the method 600 comprises causing selection of one or more second sound objects 712 of a second sound scene 702 comprising multiple second sound objects 712.

At block 608, the method 600 comprises causing selection of one or more first sound objects 711 in the first sound scene 701.

At block 610, the method 600 comprises causing rendering of a mixed sound scene 703 based in part on the first sound scene 701 and in part on a second sound scene 702, by rendering the first sound scene 701 while de-emphasising the selected one or more first sound objects 711 and emphasising the selected one or more second sound objects 712.

In some but not necessarily all examples, the method 600 comprises:

in response to direct or indirect user specification of a change in sound scene from the first sound scene 701 to a mixed sound scene 703 based in part on the first sound scene 701 and in part on a second sound scene 702, automatically causing selection of one or more second sound objects 712 of the second sound scene 702 comprising multiple second sound objects 712;

automatically causing selection of one or more first sound objects 711 in the first sound scene 701; and automatically causing rendering of a mixed sound scene 703 by rendering the first sound scene 701 while de-emphasising the selected one or more first sound objects 711 and emphasising the selected one or more second sound objects 712.

FIG. 12 illustrates a sound space comprising sound objects 710 including multiple first sound objects 711 and multiple second sound objects 712. In FIG. 13A-D sound scenes $\mathbf{700}_n$ rendered at a time $t_n$ (n=1, 2, 3, 4) using the sound objects 710 are illustrated.

The sound space may be a recorded sound space and the sound objects 710 may be recorded sound objects. Alternatively the sound space may be a synthetic sound space and the sound objects 710 may then be sound objects artificially generated ab initio or by mixing other sound objects which may or may not comprise wholly or partly recorded sound objects.

Each sound object 710 has an object position in the sound space 500 and has object characteristics that define that sound object. The object characteristics may for example be audio characteristics for example based on the audio signals 112/122 output from a portable/static microphone 110/120 before or after audio coding. One example of an audio characteristic is volume. When a sound object 710 having object position and object characteristics is rendered in a rendered sound scene it is rendered as a rendered sound object having a rendered position and rendered characteristics. The rendered characteristics may be the same or different characteristics compared to the object characteristics, where they are the same they may have the same or different values. In order to correctly render a sound object 710 as a rendered sound object 710, the rendered position is the same or similar to the object position and the rendered characteristics are the same characteristics with the same or similar values compared to the object characteristics. However, as previously described it is possible to process the audio signals representing a rendered sound object to change a position at which it is rendered and/or change the characteristics with which it is rendered.

In some but not necessarily all examples, the method 100 may comprise determining the first sound scene 701 and second sound scene 702. The sound objects 710 may be clustered into sets including a first set (the multiple first sound objects 711) and a second different set (the multiple second sound objects 712). The clustering of sound objects to for the sets may, for example, be based on positions of the sound objects 710 in the sound space and/or based on interaction between the sound objects 710 and/or based on meta data of the sound objects 710.

A first sound scene 701 comprises the multiple first sound objects 711. The multiple first sound objects 711 are schematically illustrated as round dots labelled 'a', 'b, and 'c'. These labels are used in FIGS. 13A-13D, 14A-14C, 15, 16A-16D, 18A-18C and FIG. 19.

A second sound scene 702 comprising the multiple second sound objects 712. The multiple second sound objects 712 are schematically illustrated as square dots labelled 'x', 'y, and 'z'. These labels are used in FIGS. 13A-13D, 14A-14C, 15, 16A-16D, 18A-18C and FIG. 19.

A user 18 is able to directly or indirectly specify a change in sound scene. In the illustrated example, the user 18 specifies a change in sound scene from the first sound scene 701 to a mixed sound scene 703.

Direct specification may, for example, occur when the user makes a sound editing command that changes the first sound scene 701 to the second sound scene 702. Indirect specification may, for example, occur when the user makes another command, such as a video editing command or a change in point of view, that is interpreted as a user requirement to change the first sound scene 701 to the second sound scene 702. Other examples include switching to another location in a virtual reality video (jump ahead or back in time) or switching the scene (point of view) in virtual reality video, or changing the music track of audio content with spatial audio content (in this case it is not necessarily to have visual content at all, just spatial audio).

In the following description reference to 'user specification' should be interpreted as a reference to 'direct or indirect specification'.

In this illustrated example user specification 720 of a change in the sound scene from the first sound scene 701 to the mixed sound scene 703, comprises a change in a direction of a user's attention 721 from the first sound scene 701 towards the second sound scene 702. The use of 'towards' implies that the user's attention 721 is moving towards the second sound scene 702 but at this movement in time falls short of the second sound scene 702.

A change in a direction of a user's attention 721 may be determined by a change in direction in which a user's head is oriented from pointing at the first sound scene 701 to moving towards the second sound scene 702.

As illustrated in FIG. 13A, the method 600 comprises, at time $t_1$, rendering a sound scene $\mathbf{700}_1$ (a first sound scene 701) comprising multiple first sound objects 711.

Then in response to the user specification 720 of a change in sound scene from the first sound scene 701, the method 100 automatically determines the second sound scene 702 by predicting a next sound scene to be rendered based on a change of a user's direction of attention from the first sound scene 701.

The method 600 performs automatic selection of one or more second sound objects 712 of the second sound scene 702. In this example, the one or more selected second sound objects 712 are those second sound objects 712(x) nearest to the first sound scene 701.

In some examples, 'nearest' may be determined as the second sound objects 712 that are audibly nearest the first sound scene 701. This would be the first sound object 710 of the second sound objects 712 to be heard by the user as the user change's their direction of attention (direction of hearing) from the first sound scene 701 towards the second sound scene 702.

In other examples, 'nearest' may be determined as the second sound objects 712 that is visually nearest the first sound scene 701. This would be the first sound object 710 of the second sound objects 712 to be seen by the user as the user change's their direction of attention (point of view 14) from the first sound scene 701 towards the second sound scene 702.

The method 600 performs automatic selection of one or more first sound objects 711 in the first sound scene 701. The one or more first sound objects 711 in the first sound scene 701 may, for example be selected in dependence upon the selected one or more second sound objects 712 in the second sound scene 702. For example, the one or more first sound objects 711 in the first sound scene 701 may be selected because they are different to but correspond to the selected one or more second sound objects 712 in the second sound scene 702. A sound object 712 may be different because it is at a different position and may correspond because it has one or more audio characteristics in common, such for example, loudness, pitch/tone, tempo, musical quality, frequency-time characteristics, instrument type. The determination of correspondence of sound objects 710 may be based upon an analysis of the sound objects' respective metadata and/or analysis of the audio output of the sound objects 710.

The method 100 then automatically renders a mixed sound scene 703, as illustrated in FIG. 13B, based in part on the first sound scene 701 and in part on a second sound scene 702, by rendering the first sound scene 701 ({a, b, c}) while de-emphasising the selected one or more first sound objects 711(b) and emphasising the selected one or more second sound objects 712(x).

In this example, this ultimately results in the replacement of the selected one or more first sound objects 711(b) with the selected one or more second sound objects 712(x) to produce the illustrated mixed sound scene $\mathbf{700}_2$ ({a, c, x}). The speed at which the replacement occurs may be short or long and may be variably controlled. For example the replacement may be a gradual replacement over multiple sound frames e.g. >40 ms.

In some examples, the de-emphasising of the selected one or more first sound objects 711(b) comprises fading-out volume of the selected one or more first sound objects 711(b) and emphasising the selected one or more second sound objects 712(x) comprises simultaneously fading-in volume of the selected one or more second sound objects 712(x). This may be achieved as a simultaneous balanced cross-fade. This is schematically illustrated in FIG. 14A, where a volume indicator 730 for the selected one or more first sound objects 711(b) decreases while the volume indicator 730 for the selected one or more second sound objects 712(x) simultaneously increases.

Then in response to further user specification 720 of a change in sound scene towards the second sound scene 702, the method 600 performs automatic selection of one or more further second sound objects 712(y) of the second sound scene 702.

As previously described the one or more selected second sound objects 712(x) are those sound objects 710 nearest to the first sound scene 701. The one or more further selected second sound objects 712(y) are those second sound objects 712 next nearest to the first sound scene 701.

In some examples, 'next nearest' may be determined as the second sound objects 712 that are audibly second nearest the first sound scene 701. This would be the second sound object 710 of the second sound objects 712 to be heard by the user as the user change's their direction of attention (direction of hearing) from the first sound scene 701 towards the second sound scene 702.

In other examples, 'next nearest' may be determined as the second sound objects 712 that are visually second nearest the first sound scene 701. This would be the second sound object 710 of the second sound objects 712 to be seen by the user as the user change's their direction of attention (point of view 14) from the first sound scene 701 towards the second sound scene 702.

Then the method 600 performs automatic selection of one or more further first sound objects 711(c) in the first sound scene 701. The one or more further first sound objects 711(c) in the first sound scene 701 may, for example be selected in dependence upon the further selected one or more second sound objects 712(y) in the second sound scene 702. For example, the one or more further first sound objects 711(c) in the first sound scene 701 may be selected because they are different to but correspond to the further selected one or more second sound objects 712(y) in the second sound scene 702.

The method 100 then automatically renders a mixed sound scene 703 ({a, x, y}), as illustrated in FIG. 13C, based in part on the first sound scene 701 and in part on a second sound scene 702, by rendering the first sound scene 701 ({a, b, c}) without the selected one or more first sound objects 711(b) and with the selected one or more second sound objects 712(x) while de-emphasising the further selected one or more first sound objects 711(c) and emphasising the further selected one or more second sound objects 712(y).

In this example, this ultimately results in the replacement of the further selected one or more first sound objects 711 with the further selected one or more second sound objects 712 to produce the illustrated mixed sound scene $\mathbf{700}_3$ ({a, x, y}). The speed at which the replacement occurs may be short or long and may be variably controlled. For example the replacement may be a gradual replacement over multiple sound frames e.g. >40 ms.

Thus In some examples, the de-emphasising the of further selected one or more first sound objects 711(c) comprises fading-out volume of the further selected one or more first sound objects 711(c) and emphasising the further selected one or more second sound objects 712(y) comprises simultaneously fading-in volume of the further selected one or more second sound objects 712(y). This may be achieved as a simultaneous balanced cross-fade. This is schematically illustrated in FIG. 14B, where a volume indicator 730 for the further selected one or more first sound objects 711(c)

decreases while the volume indicator 730 for the further selected one or more second sound objects 712(y) simultaneously increases.

Then in response to further user specification 720 of a change in sound scene to the second sound scene 702, the method 600 performs automatic selection of one or more remaining un-rendered second sound objects 712(z) that are not yet rendered. The use of 'to' implies that the user's attention 721 is now directed at the second sound scene 702.

The method 600 automatically then causes automatic selection of one or more remaining rendered first sound objects 711(a) that are still being rendered. The method 100 then automatically renders the second sound scene 702 ({x, y, z}), as illustrated in FIG. 13D by de-emphasising the selected one or more remaining rendered first sound objects 711(a) and emphasising the selected one or more remaining un-rendered second sound objects 712(z).

In this example, this ultimately results in the replacement of the selected one or more remaining first sound objects 711 with the selected one or more remaining second sound objects 712 to produce the second sound scene 702 ({x, y, z}). The speed at which the replacement occurs may be short or long and may be variably controlled. For example the replacement may be a gradual replacement over multiple sound frames e.g. >40 ms.

Thus In some examples, the de-emphasising of the selected one or more remaining rendered first sound objects 711(a) comprises fading-out volume of those selected one or more remaining first sound objects 711(a) and emphasising the selected one or more remaining un-rendered second sound objects 712(z) comprises simultaneously fading-in volume of those selected one or more remaining second sound objects 712(z). This may be achieved as a simultaneous balanced cross-fade. This is schematically illustrated in FIG. 14C, where a volume indicator 730 for the selected one or more remaining first sound objects 711(a) decreases while the volume indicator 730 for the selected one or more remaining second sound objects 712(z) simultaneously increases.

While the FIGS. 13B, 13C illustrate rendered mixed sound scenes 703, at particular times, for example, sound scene $\mathbf{700}_2$ at a time $t_2$ and sound scene $\mathbf{700}_3$ at a time $t_3$.

It should be understood from the above description that these mixed sound scenes 703 may only exist temporarily and that there may be many other transitional mixed sound scenes 703 between the time $t_1$ when the first sound scene is rendered and the time $t_4$, in this example, when the second sound scene 702 is rendered as different ones of the first sound objects 711 transition out of the rendered sound scene $\mathbf{700}_n$ and different ones of the second sound objects 712 transition in to the rendered sound scene $\mathbf{700}_n$ (where $0<n<4$).

The particular transitional mixed sound scene $\mathbf{700}_T$ rendered at transitional time $t_T$ ($t_1<t_T<t_4$) will depend upon when the first sound objects 711 are transitioned out of the rendered sound scene 700, and how they are transitioned out and will depend upon when the second sound objects 712 are transitioned in to the rendered sound scene 700 and how they are transitioned in.

As described above when and how quickly the second sound objects 712 are transitioned into the rendered sound scene 700 may depend upon when and how quickly the user changes the direction of attention 721, it may be desirable for the transitioning of the second sound objects 711 into the rendered sound scene to be synchronized with the change in direction of the user's attention 721. For example, rendering of a second sound object 711 is started when that second sound object 711, because of its position, should be perceived (hear and/or see equivalent visual element) by the user 18.

As described above when and how quickly the first sound objects 711 are transitioned out of the rendered sound scene 700 may depend upon when and how quickly the second sound objects 711 are transitioned out of the rendered sound scene 700. For example, rendering of a first sound object 711 is adapted to start a transition out, when one or more corresponding second sound objects 712 are starting to be transitioned into the sound scene.

The rate at which a sound object 710 transitions out of a sound scene 700 may be controlled by an algorithm and the rate at which a sound object transitions in may be controlled by an equivalent algorithm to achieve a desired effect. A transition in/out may for example be linear or non-linear, the rate of transition may depend upon actual or perceived size of transition required (e.g. volume change), and the rate of transition may depend upon the rate at which the user attention 721 changes.

Figure 19:
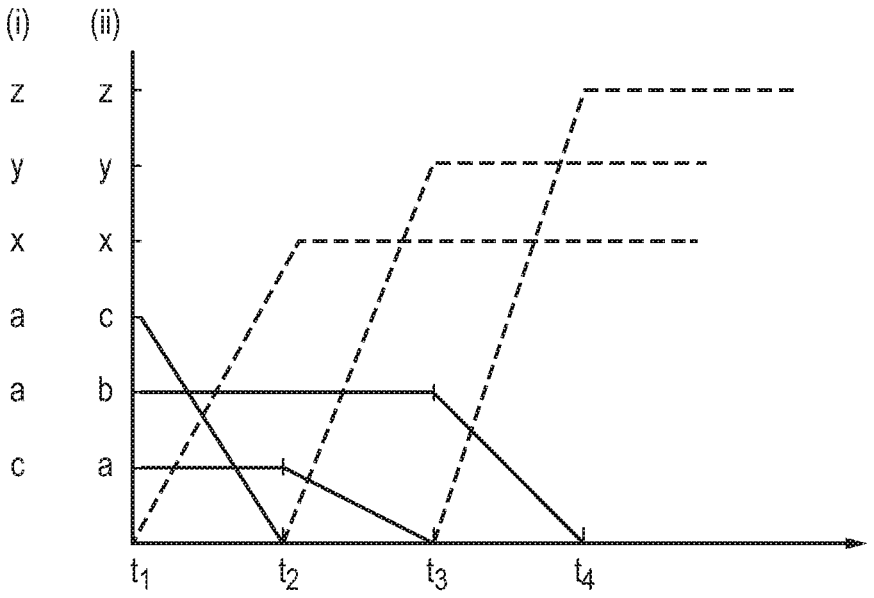
FIG. 19 illustrates examples of transitioning in sound objects and transitioning out sound objects to achieve the sound scenes illustrated in FIGS. 13B-13D respectively (i) and to achieve the sound scenes illustrated in FIGS. 16B-16D respectively (ii).

FIG. 19 plots representations of the volume of different sound objects 710 on the y-axis against time on the x-axis. Each sound object 710 is labelled with a designating letter (a, b, c, x, y, z) and has its own independent linear volume scale for the y-axis. The sound scene transitions illustrated in FIGS. 13A to 13D are represented by the sound objects labelled (i) at the y-axis.

The FIG. 19(i) illustrates an example of the transition from the first sound scene 701 represented by the set of sound objects {a, b, c} at time $t_1$ to the second sound scene 702 represented by the set of sound objects {x, y, z} at time $t_4$ via the illustrated intermediate mixed sound scenes 703 illustrated in FIGS. 13B & 13C namely the set of sound objects {a, c, x} at time $t_2$ (b has transitioned out and x has transitioned in) and the set of sound objects {a, x, y} at time $t_3$ (c has now transitioned out and y has transitioned in). The transitioning in of a sound object 710 is achieved by fading-in the sound object (rising dotted line in the figure) with a linear increase in volume, at a rate dependent upon the volume increase to be achieved in the time available for the transition which is dependent upon the rate of change of user attention 721 (but other fade-in is possible). The transitioning out of a sound object 710 is achieved by fading-out the sound object (falling solid line in the figure) with a linear decrease in volume, at a rate dependent upon the volume decrease to be achieved in the time available for the transition which is dependent upon the rate of change of user attention 721 (but other fade-in is possible).

The 'forward' transition of the first sound scene 701 to the second sound scene 702 illustrated in FIGS. 13-13D and FIG. 19 may, for example be reversed at any time between time $t_1$ and time $t_4+\Delta t$, where $\Delta t$ is a small defined time value ($\Delta t \geq 0$). This may, for example be achieved by the user reversing the change in attention that has caused the 'forward' transition to undo (reverse) the transition. This may be performed in each relevant time segment. This allows the user to preview the second sound scene 702 by directing attention towards the second sound scene 702 temporarily.

Thus in response to user specification 720 of a change in sound scene 700 back to the first sound scene 701, the method 100 causes automatic selection of one or more rendered second sound objects 712 of the second sound scene 702 that are being rendered; automatic selection of one or more un-rendered first sound objects 711 in the first sound scene 701 that are not being rendered; and automatic rendering of the first sound scene 701 by de-emphasising the selected one or more rendered second sound objects 712 and emphasising the selected one or more un-rendered first sound objects 711.

In the foregoing description reference has been made to different selections of one or more of the second sound objects 712 to transition between the first sound scene 701 and the second sound scene 702. Where multiple second sound objects 712 are selected at the same time, this group of second sound objects 712 may be selected because there is interaction between those second sound objects 712. Such interaction may be determined by detecting close proximity between the second sound objects 712 and/or a relationship between the second sound objects 712 (e.g. a back and forth conversation or instruments playing same music etc). The determination may, for example, be based on analysis of metadata (including position) for the second sound objects 712 and/or analysis of the audio output of the second sound objects 712

FIGS. 15, 16A-16D and 18A-18C are very similar to FIGS. 12, 13A-13D and 14A-14C in so far as they relate to sound objects 710 and sound scenes 700 and the description of FIGS. 15, 16A-16D and 18A-18C is largely included by reference for FIGS. 12, 13A-13D and 14A-14C and not repeated for the purpose of clarity of description. It should however be noted that there are some minor differences between FIGS. 15, 16A-16D and 18A-18C and FIGS. 12, 13A-13D and 14A-14C in so far as they relate to sound objects 710.

Figure 15:
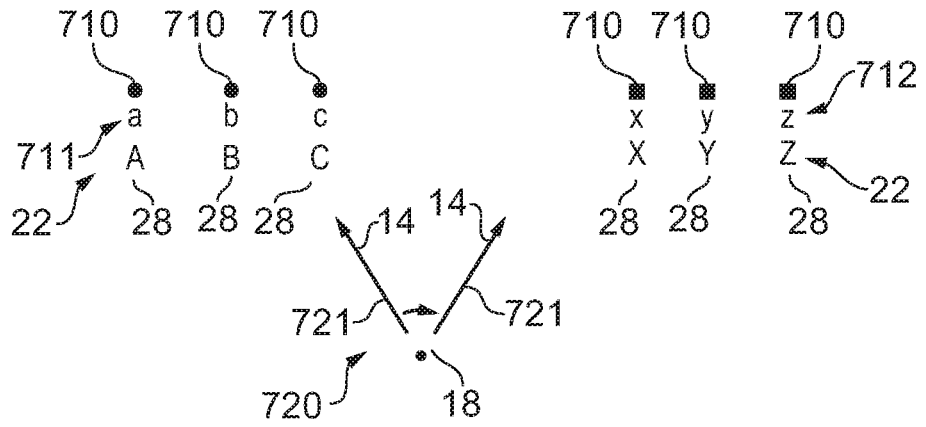
FIG. 15 illustrates a sound space comprising sound objects including multiple first sound objects and multiple second sound objects and also illustrates associated visual elements.
Figure 16A:
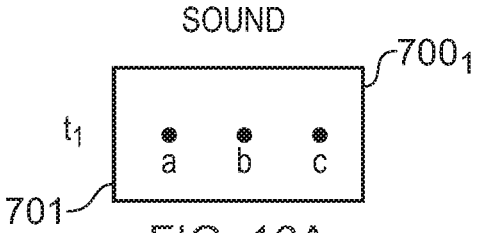
FIGS. 16A to 16D illustrate examples of sound scenes rendered at successive times.
Figure 16B:
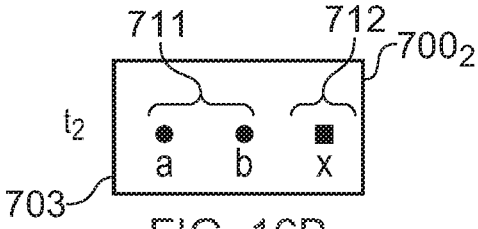
Figure 16C:
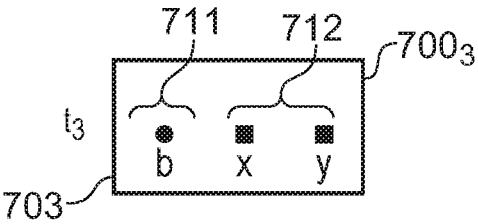

The first sound scene 701 represented by the set of sound objects {a, b, c} at time $t_1$ (FIG. 16A) transitions to the second sound scene 702 represented by the set of sound objects {x, y, z} at time $t_4$ (FIG. 16D) via the illustrated intermediate mixed sound scenes 703 illustrated in FIGS. 16B & 16C as described above. However, the mixed sound scene $\mathbf{700}_2$ at time $t_2$ is defined by the set of sound objects ({a, b, x})(c has transitioned out rather than b, and x has transitioned in—see FIG. 18A) and the mixed sound scene $\mathbf{700}_3$ at time $t_3$ is defined by the set of sound objects ({b, x, y}) (a has transitioned out rather than c, and y has transitioned in—see FIG. 18B). This is to illustrate that the selection of the second sound objects 712 for transitioning in is ordered (x then y then z) based on the 'nearness' of the second sound objects 712 but that the transitioning out of the first sound objects 711 is not ordered (b then c then a, in FIGS. 13A-16D, but c then a then b, in FIGS. 16A-16D), and is not based on 'nearness'. As explained above the first sound object 711 selected for transitioning out may be dependent upon the second sound object 712 that has already been selected for transitioning in.

The other purpose of FIGS. 15, 16A-16D and 18A-18C and the purpose of FIGS. 17A-17D, is to illustrate the operation of the method 600 when not only sound objects 710 are rendered in a sound scene 700 but also corresponding visual elements 28 are simultaneously rendered in a corresponding visual scene 22, for example a virtual visual scene.

Referring to FIG. 15, it is the same as FIG. 12 except that in addition to the sound objects 710 (first sound objects 711 and the second sound objects 712) there are illustrated visual elements 28. In this example each of the sound objects 710 is associated with a corresponding visual element 28 that visually represents that sound object 710. For example, a sound object 710 may render dialogue recorded from an object (which may be a person) and the associated visual element 28 may be a captured moving or still image or visual representation of that object. It is of course desirable to time and space synchronise a moving image or representation of an object with the associated first sound object 711, which is a spatial sound object.

The visual elements 28 represented by labels 'A', 'B', 'C' are associated with the first sound objects 711 represented respectively by labels 'a', 'b', 'c'. The visual elements represented by labels 'X', 'Y', 'Z' are associated with the second sound objects 712 represented respectively by labels 'x', 'y', 'z'.

Also in FIG. 15, user specification 720 of a change in sound scene comprises a change in the user's point of view 14. The change in a direction of a user's attention 721 is determined by a change in direction of a user's point of view 14. This may be determined by head orientation and/or gaze detection The point of view 14 may, for example, be freely chosen by the user 18.

Referring to FIGS. 16A-16D & 18A-18C, they are the same as FIGS. 13A-13D & 14A-14C except that the order in which the first sound objects 711 transition out of the sound scenes is different. The order of transitioning out is c, a, b in FIGS. 16A-16D and FIGS. 18A-18C whereas in FIGS. 13A-13D & 14A-14C it is b, c, a. Otherwise the figures are the same and the same description taking into account the differences is applicable and included by reference.

Figure 17A:
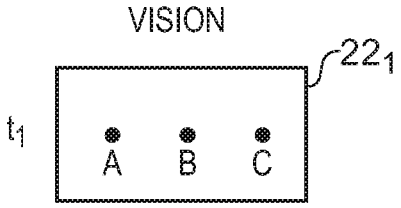
FIGS. 17A to 17D illustrate examples of the corresponding visual scenes rendered at those successive times.
Figure 17B:
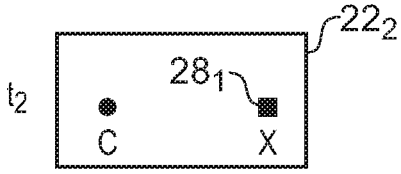
Figure 17C:
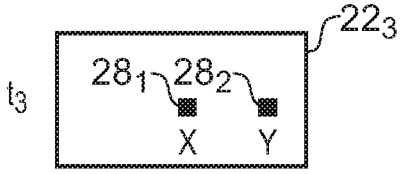
Figure 17D:
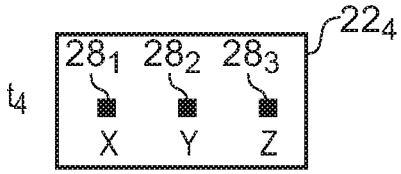
Figure 18A:
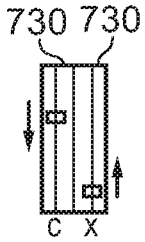
FIGS. 18A-18C illustrate examples of simultaneously transitioning in a sound object and transitioning out a sound object to achieve the sound scenes illustrated in FIGS. 16B-16D respectively.
Figure 18B:
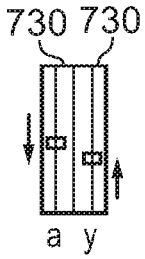
Figure 18C:
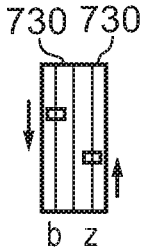

FIGS. 17A to 17D illustrate the visual scene 22 rendered to the user at the times $t_1$ (FIG. 17A), $t_2$ (FIG. 17B), $t_3$ (FIG. 17C), $t_4$ (FIG. 17D).

As illustrated in FIGS. 16A and 17A, the method 600 comprises: at time $t_1$, rendering a sound scene $\mathbf{700}_1$ (a first sound scene 701) comprising only multiple first sound objects 711 and also automatically rendering in the display a first visual scene $\mathbf{22}_1$ determined by the field of view and the user point of view 14 at time $t_1$. The first visual scene $\mathbf{22}_1$ associated with the first sound scene $\mathbf{700}_1$ also corresponds (is time synchronized) with the first visual scene $\mathbf{22}_1$.

As illustrated in FIGS. 16B and 17B, the method 600 comprises: at time $t_2$, rendering a sound scene $\mathbf{700}_2$ (a mixed sound scene 703) comprising a set of first sound objects 711 ({a, b}) and a set of second sound objects 712(x) and automatically rendering an intermediate visual scene $\mathbf{22}_2$ determined by a field of view and the user point of view 14 at time $t_2$.

As illustrated in FIGS. 16C and 17C, the method 600 comprises: at time $t_3$, rendering a sound scene $\mathbf{700}_3$ (a mixed sound scene 703) comprising a set of first sound objects 711(b) and a set of second sound objects 712(x, y) and automatically rendering an intermediate visual scene $\mathbf{22}_3$ determined by a field of view and the user point of view 14 at time $t_3$.

Figure 16D:
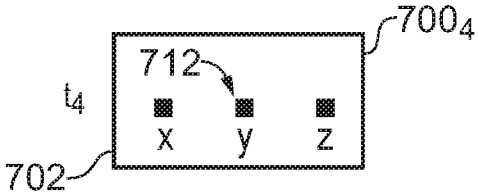

As illustrated in FIGS. 16D and 17D, the method 600 comprises: at time $t_4$, rendering a sound scene $\mathbf{700}_4$ (a second sound scene 702) comprising only second sound objects 712 and automatically rendering a second visual scene $\mathbf{22}_4$ determined by a field of view and the user point of view 14 at time $t_4$.

Rendering of a visual element 28 of the second visual scene (X, Y, Z) associated with a second sound object 712 is accompanied by rendering of the associated second sound object. The visual element 28 of the second visual scene (X, Y, Z) and its associated second sound object 712 are rendering with correspondence (e.g. time and space synchronization).

At time $t_2$, rendering of a visual element $\mathbf{28}_1$ (X) of the second visual scene (X, Y, Z) associated with a second sound object 712(x) is accompanied by rendering of the associated second sound object (x). At time $t_3$, rendering of some of the visual elements 28 (X, Y) of the second visual scene (X, Y, Z) associated with second sound objects 712(x, y) is accompanied by rendering of the associated second sound objects (x, y). At time $t_4$, rendering all of the visual elements 28 (X, Y, Z) of the second visual scene (X, Y, Z) associated with second sound objects 712(x, y, z) is accompanied by rendering of the associated second sound objects (x, y, z).

While there are gradual transitions, as described above between the second sound objects 712 that transition in (e.g. fade-in) and the first sound objects 711 that transition out (e.g. fade out), there are no equivalent gradual transitions between visual objects 28, which are either wholly or partly displayed (in the visual scene 22) or not displayed (not in the visual scene 22).

The visual objects 28 (X, Y, Z) of the second visual scene $\mathbf{22}_4$ are newly rendered in successive rendered visual scenes $\mathbf{22}_2$, $\mathbf{22}_3$, $\mathbf{22}_4$ in the order in which they are viewed by the user while changing their point of view 14 (X then Y, then Z). This causes the ordered rendering of the second sound objects 712.

The second sound objects 712(x, y, z) of the second sound scene 702 are newly rendered in successive rendered sound scenes $\mathbf{700}_2$, $\mathbf{700}_3$, $\mathbf{700}_4$ in the order in which their associated visual elements (X, Y, Z) are viewed by the user while changing their point of view 14 (x then y, then z).

However, the order in which the first sound objects 711 are no longer rendered is dependent upon the order in which the second sound objects 712 are newly rendered and the correspondence between the second sound objects 712 and the first sound objects 711 (the transition in of a second sound object 712 may cause the transition out of the corresponding first sound object 711). The order in which the first sound objects are no longer rendered is therefore independent of whether or not the visual objects 28 (A, B, C) of the first visual scene associated with the first sound objects 711 are or are not rendered.

Therefore rendering of a visual element 28 (X, FIG. 17B; X,Y FIG. 17C; X,Y, Z FIG. 17D) of the second visual scene $\mathbf{22}_4$ associated with a second sound object 712

(x, FIG. 16B; x,y FIG. 16B; x,y,z FIG. 16D) is accompanied by rendering of the associated second sound object 712 and rendering of second sound object 712 associated with a visual element 28 of the second visual scene is accompanied by rendering of the associated visual element 28. However, rendering a visual element 28 (C, FIG. 17B) of the first visual scene $\mathbf{22}_1$ associated with a first sound object 711(c) is not necessarily accompanied by rendering of the associated first sound object (see FIG. 16B) and rendering of a first sound object 711 (a, b FIG. 16B; b, FIG. 16C) associated with a visual element (A, B, C) of the first visual scene is not necessarily accompanied by rendering of the associated visual element (see FIGS. 17B, 17C).

Referring to FIG. 19, the sound scene transitions illustrated in FIGS. 16A to 16D are represented by the sound objects labelled (ii) at the y-axis.

The FIG. 19(ii) illustrates an example of the transition from the first sound scene 701 represented by the set of sound objects {a, b, c} at time $t_1$ to the second sound scene 702 represented by the set of sound objects {x, y, z} at time $t_4$ via the illustrated intermediate mixed sound scenes 703 illustrated in FIGS. 16B & 16C namely the set of sound objects {a, b, x} at time $t_2$ (c has transitioned out and x has transitioned in) and the set of sound objects {b, x, y} at time $t_3$ (a has now transitioned out and y has transitioned in).

The transitioning in of a second sound object 710 starts when the user directs their point of view 14 towards the visual element 28 associated with that second sound object 712. That is, the transitioning in of a second sound object 710 starts when the visual element 28 associated with that second sound object 712 enters the visual scene 22.

The transitioning in of a sound object 710 is achieved by fading-in the sound object (rising dotted line in the figure) with a linear increase in volume, at a rate dependent upon the volume increase to be achieved in the time available for the transition which is dependent upon the rate of change of user point of view 14 (but other fade-in is possible).

The transitioning out of a sound object 710 is achieved by fading-out the sound object (falling solid line in the figure) with a linear decrease in volume, at a rate dependent upon the volume decrease to be achieved in the time available for the transition which is dependent upon the rate of change of user attention 721 (but other fade-in is possible).

The 'forward' transition of the first sound scene 701 to the second sound scene 702 illustrated in FIGS. 16-16D and FIG. 19 may, for example be reversed at any time between time $t_1$ and time $t_4+\Delta t$, where $\Delta t$ is a small defined time value ($\Delta t \geq 0$). This may, for example be achieved by the user reversing the change in point of view 14 that has caused the 'forward' transition to undo (reverse) the transition. This may be performed in each relevant time segment. This allows the user to preview the second sound scene 702 by directing their gaze towards the second sound scene 702 temporarily.

The methods as described with reference to FIGS. 11 to 19 may be performed by any suitable apparatus (e.g. apparatus 30, 400), computer program (e.g. computer program 46, 416) or system (e.g. system 100) such as those previously described or similar.

In the foregoing examples, reference has been made to a computer program or computer programs. A computer program, for example either of the computer programs 48, 416 or a combination of the computer programs 48, 416 may be configured to perform the method 520.

Also as an example, an apparatus 30, 400 may comprises: at least one processor 40, 412; and at least one memory 46, 414 including computer program code the at least one memory 46, 414 and the computer program code configured to, with the at least one processor 40, 412, cause the apparatus 430, 00 at least to perform: causing rendering of a first sound scene comprising multiple first sound objects; in response to direct or indirect user specification of a change in sound scene from the first sound scene to a mixed sound scene based in part on the first sound scene and in part on a second sound scene; causing selection of one or more second sound objects of the second sound scene comprising multiple second sound objects; causing selection of one or more first sound objects in the first sound scene; and causing rendering of a mixed sound scene by rendering the first sound scene while de-emphasising the selected one or more first sound objects and emphasising the selected one or more second sound objects.

The computer program 48, 416 may arrive at the apparatus 30, 400 via any suitable delivery mechanism. The delivery mechanism may be, for example, a non-transitory computer-readable storage medium, a computer program product, a memory device, a record medium such as a compact disc read-only memory (CD-ROM) or digital versatile disc (DVD), an article of manufacture that tangibly embodies the computer program 48, 416. The delivery mechanism may be a signal configured to reliably transfer the computer program 48, 416. The apparatus 30, 400 may propagate or transmit the computer program 48, 416 as a computer data signal. FIG. 10 illustrates a delivery mechanism 430 for a computer program 416.

It will be appreciated from the foregoing that the various methods 600 described may be performed by an apparatus 30, 400, for example an electronic apparatus 30, 400.

The electronic apparatus 400 may in some examples be a part of an audio output device 300 such as a head-mounted audio output device or a module for such an audio output device 300. The electronic apparatus 400 may in some examples additionally or alternatively be a part of a head-mounted apparatus 33 comprising the display 32 that displays images to a user.

References to 'computer-readable storage medium', 'computer program product', 'tangibly embodied computer program' etc. or a 'controller', 'computer', 'processor' etc. should be understood to encompass not only computers having different architectures such as single/multi-processor architectures and sequential (Von Neumann)/parallel architectures but also specialized circuits such as field-programmable gate arrays (FPGA), application specific circuits (ASIC), signal processing devices and other processing circuitry. References to computer program, instructions, code etc. should be understood to encompass software for a programmable processor or firmware such as, for example, the programmable content of a hardware device whether instructions for a processor, or configuration settings for a fixed-function device, gate array or programmable logic device etc.

As used in this application, the term 'circuitry' refers to all of the following:

(a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions and (c) to circuits, such as a microprocessor(s) or a portion of a microprocessor(s), that require software or firmware for operation, even if the software or firmware is not physically present.

This definition of 'circuitry' applies to all uses of this term in this application, including in any claims.

As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in a server, a cellular network device, or other network device.

The blocks, steps and processes illustrated in the FIGS. 11-19 may represent steps in a method and/or sections of code in the computer program. The illustration of a particular order to the blocks does not necessarily imply that there is a required or preferred order for the blocks and the order and arrangement of the block may be varied. Furthermore, it may be possible for some blocks to be omitted.

Where a structural feature has been described, it may be replaced by means for performing one or more of the functions of the structural feature whether that function or those functions are explicitly or implicitly described.

As used here 'module' refers to a unit or apparatus that excludes certain parts/components that would be added by an end manufacturer or a user. The controller 42 or controller 410 may, for example be a module. The apparatus may be a module. The display 32 may be a module.

The term 'comprise' is used in this document with an inclusive not an exclusive meaning. That is any reference to X comprising Y indicates that X may comprise only one Y or may comprise more than one Y. If it is intended to use 'comprise' with an exclusive meaning then it will be made clear in the context by referring to "comprising only one . . . " or by using "consisting".

In this brief description, reference has been made to various examples. The description of features or functions in relation to an example indicates that those features or functions are present in that example. The use of the term 'example' or 'for example' or 'may' in the text denotes, whether explicitly stated or not, that such features or functions are present in at least the described example, whether described as an example or not, and that they can be, but are not necessarily, present in some of or all other examples. Thus 'example', 'for example' or 'may' refers to a particular instance in a class of examples. A property of the instance can be a property of only that instance or a property of the class or a property of a sub-class of the class that includes some but not all of the instances in the class. It is therefore implicitly disclosed that a features described with reference to one example but not with reference to another example, can where possible be used in that other example but does not necessarily have to be used in that other example.

Although embodiments of the present invention have been described in the preceding paragraphs with reference to various examples, it should be appreciated that modifications to the examples given can be made without departing from the scope of the invention as claimed. For example, although embodiments of the invention are described above in which multiple video cameras 510 simultaneously capture live video images 514, in other embodiments it may be that merely a single video camera is used to capture live video images, possibly in conjunction with a depth sensor.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. A method comprising:

determining a point of view of a user of an apparatus within a virtual space, where the virtual space comprises an artificial environment;

causing rendering, with the apparatus, of a first sound scene of a sound space based on the determined point of view of the user, wherein the rendering of the first sound scene comprises rendering multiple first sound objects corresponding to the first sound scene;

in response to a user input into the apparatus specifying a change in the determined point of view of the user from the first sound scene towards a second sound scene of the sound space:

causing selection of one or more second sound objects of the second sound scene, wherein the second sound scene comprises multiple ones of the second sound objects;

causing selection of one or more of the first sound objects being rendered in the first sound scene based, at least partially, on the selected one or more second sound objects, wherein selecting the one or more first sound objects in the first sound scene is based at least on a similarity of at least one audio characteristic of the one or more selected first sound objects and the selected one or more second sound objects in the second sound scene;

causing rendering of a mixed sound scene based at least partially on the first sound scene and at least partially on the second sound scene, wherein the rendering of the mixed sound scene comprises at least rendering the first sound scene while de-emphasising the selected one or more first sound objects and emphasising the selected one or more second sound objects; and causing rendering of a first visual scene of a visual space based on a field of view and the change in the determined point of view of the user, wherein the visual space corresponds, at least partially, to the sound space such that the first visual scene corresponds, at least partially, to the first sound scene and a second visual scene corresponds, at least partially, to the second sound scene.

2. A method as claimed in claim 1, wherein de-emphasising the selected one or more first sound objects and emphasising the selected one or more second sound objects comprises replacing the selected one or more first sound objects with the selected one or more second sound objects.

3. A method as claimed in claim 1, wherein de-emphasising the selected one or more first sound objects and emphasising the selected one or more second sound objects comprises fading-out volume of the selected one or more first sound objects and fading-in volume of the selected one or more second sound objects.

4. A method as claimed in claim 1, wherein the change in the determined point of view of the user from the first sound scene towards the second sound scene comprises a change in a direction of a user's attention from the first sound scene towards the second sound scene, and wherein the method comprises predicting a next sound scene to be rendered based on the change of the user's direction of attention.

5. A method as claimed in claim 1, wherein at least one of the one or more selected second sound objects is different from the first sound objects.

6. A method as claimed in claim 1, wherein causing rendering of the mixed sound scene comprises rendering the first sound scene while de-emphasising the selected one or more first sound objects and emphasising simultaneously selected multiple second sound objects that have been selected in dependence upon determined interaction between the second sound objects.

7. A method as claimed in claim 1, in response to a further user input into the apparatus specifying a further change in the determined point of view of the user from the first sound scene towards the second sound scene, causing automatic selection of one or more further second sound objects of the second sound scene;

causing automatic selection of one or more further first sound objects in the first sound scene; and causing automatic rendering of a new mixed sound scene, where the automatic rendering comprises rendering the first sound-scene without the selected one or more first sound objects and with the selected one or more second sound objects while de-emphasising the further selected one or more first sound objects and emphasising the further selected one or more second sound objects.

8. A method as claimed in claim 7, wherein the one or more selected second sound objects are those sound objects nearest to the first sound scene in the audio space and the one or more further selected second sound objects are those second sound objects next nearest to the first sound scene; and/or wherein the selected one or more further first sound objects in the first sound scene are selected in dependence upon the further selected one or more second sound objects in the second sound scene.

9. A method as claimed in claim 1, comprising:

in response to a further user input into the apparatus specifying a further change in the determined point of view of the user from the first sound scene towards the second sound scene:

causing automatic selection of one or more remaining second sound objects that are not yet selected;

causing automatic selection of one or more first sound objects; and causing automatic rendering of the second sound scene, where the automatic rendering comprises de-emphasising the selected one or more first sound-objects and emphasising the selected one or more remaining second sound objects.

10. A method as claimed in claim 1, comprising:

in response to a further user input into the apparatus specifying a further change in the determined point of view of the user back to the first sound scene:

causing automatic selection of one or more of the second sound objects of the second sound scene that are being rendered in the mixed sound scene;

causing automatic selection of one or more of the first sound objects that are in the first sound scene that were previously rendered in the mixed sound scene; and causing automatic rendering of the first sound scene, where the automatic rendering comprises de-emphasising the selected one or more second sound objects that are being rendered in the mixed sound scene and emphasising the selected one or more first sound objects that were previously rendered in the mixed sound scene.

11. A method as claimed in claim 1, comprising associating one or more first visual elements within the first visual scene with one or more of the first sound objects and one or more second visual elements within the second visual scene with one or more of the second sound objects, and while rendering the mixed sound scene, at least one of:

rendering at least one of the second visual elements of the second visual scene and rendering the one or more of the second sound objects associated with the second visual element;

rendering at least one of the first visual elements of the first visual scene and not rendering the associated one or more first sound objects; or rendering at least one of the first sound objects associated with at least one of the first visual elements without rendering the associated first visual element.

12. A method as claimed in claim 1 wherein the causing selection of the one or more of the first sound objects being rendered in the first sound scene comprises causing selection of less than all of the first sound objects.

13. A method as claimed in claim 1, wherein at least one of the selected one or more second sound objects is not one of the multiple first sound objects.

14. An apparatus comprising:

at least one processor; and at least one non-transitory memory including computer program code, the at least one non-transitory memory and the computer program code configured to, with the at least one processor, cause the apparatus to perform at least the following:

determining a point of view of a user of the apparatus within a virtual space, where the virtual space comprises an artificial environment;

causing rendering of a first sound scene of a sound space based on the determined point of view of the user, wherein rendering the first sound scene comprises rendering multiple first sound objects corresponding to the first sound scene;

in response to a user input into the apparatus specifying a change in the determined point of view of the user from the first sound scene towards a second sound scene of the sound space:

causing selection of one or more second sound objects of the second sound scene, wherein the second sound scene comprises multiple ones of the second sound objects;

causing selection of one or more of the first sound objects in the first sound scene based, at least partially, on the selected one or more second sound objects, wherein selecting the one or more first sound objects in the first sound scene is based at least on a similarity of at least one audio characteristic of the one or more selected first sound objects and the selected one or more second sound objects in the second sound scene;

causing rendering of a mixed sound scene based at least partially on the first sound scene and at least partially on the second sound scene, wherein the rendering of the mixed sound scene comprises at least rendering the first sound scene while de-emphasising the selected one or more first sound objects and emphasising the selected one or more second sound objects; and causing rendering of a first visual scene of a visual space based on a field of view and the change in the determined point of view of the user, wherein the visual space corresponds, at least partially, to the sound space such that the first visual scene corresponds, at least partially, to the first sound scene and a second visual scene corresponds, at least partially, to the second sound scene.

15. The apparatus of claim 14, wherein de-emphasising the selected one or more first sound objects and emphasising the selected one or more second sound objects comprises replacing the selected one or more first sound objects with the selected one or more second sound objects.

16. The apparatus of claim 14, wherein de-emphasising the selected one or more first sound objects and emphasising the selected one or more second sound objects comprises fading-out volume of the selected one or more first sound objects and fading-in volume of the selected one or more second sound objects.

17. The apparatus of claim 14, wherein the change in the determined point of view of the user from the first sound scene towards the second sound scene comprises a change in a direction of a user's attention from the first sound scene towards the second sound scene wherein the at least one non-transitory memory and the computer program code are configured to, with the at least one processor, further cause the apparatus to perform predicting a next sound scene to be rendered based on the change of the user's direction of attention.

18. The apparatus of claim 14, wherein causing rendering of the mixed sound scene comprises rendering the first sound scene while de-emphasising the selected one or more first sound objects and emphasising simultaneously selected multiple second sound objects that have been selected in dependence upon determined interaction between the second sound objects.

19. A non-transitory computer readable medium comprising computer program code stored thereon, the non-transitory computer readable medium and computer program code being configured to, when run on at least one processor, cause an apparatus to perform at least the following:

determine a point of view of a user of the apparatus within a virtual space, where the virtual space comprises an artificial environment;

cause rendering of a first sound scene of a sound space based on the determined point of view of the user, wherein rendering the first sound scene comprises rendering multiple first sound objects corresponding to the first sound scene;

in response to a user input into the apparatus specifying a change in the determined point of view of the user from the first sound scene towards a second sound scene of the sound space:

cause selection of one or more second sound objects of the second sound scene, wherein the second sound scene comprises multiple ones of the second sound objects;

cause selection of one or more first sound objects in the first sound scene based, at least partially, on the selected one or more second sound objects, wherein selecting the one or more first sound objects in the first sound scene is based at least on a similarity of at least one audio characteristic of the one or more selected first sound objects and the selected one or more second sound objects in the second sound scene;

cause rendering of a mixed sound scene based at least partially on the first sound scene and at least partially on the second sound scene, wherein the rendering of the mixed sound scene comprises at least rendering the first sound scene while de-emphasising the selected one or more first sound objects and emphasising the selected one or more second sound objects; and cause rendering of a first visual scene of a visual space based on a field of view and the change in the determined point of view of the user, wherein the visual space corresponds, at least partially, to the sound space such that the first visual scene corresponds, at least partially, to the first sound scene and a second visual scene corresponds, at least partially, to the second sound scene.

* * * * *